US012509755B2

(12) United States Patent
Allion et al.

(10) Patent No.: US 12,509,755 B2
(45) Date of Patent: Dec. 30, 2025

(54) AUSTENITIC STAINLESS-STEEL, PLATES FOR HEAT EXCHANGERS, AND CHIMNEY DUCTS MADE WITH THIS STEEL

(71) Applicant: APERAM, Luxembourg (LU)

(72) Inventors: Audrey Allion, Lomme (FR); Jessica Delacroix, Bethune (FR); Bertrand Petit, Auchel (FR)

(73) Assignee: APERAM, Luxembourg (LU)

( * ) Notice: Subject to any disclaimer, the term of this patent is extended or adjusted under 35 U.S.C. 154(b) by 382 days.

(21) Appl. No.: 18/267,307

(22) PCT Filed: Dec. 13, 2021

(86) PCT No.: PCT/IB2021/061647
§ 371 (c)(1),
(2) Date: Jun. 14, 2023

(87) PCT Pub. No.: WO2022/130176
PCT Pub. Date: Jun. 23, 2022

(65) Prior Publication Data

US 2024/0018638 A1 Jan. 18, 2024

(30) Foreign Application Priority Data

Dec. 16, 2020 (WO) ..... PCT/IB2020/062043

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/02* (2013.01); *C22C 38/22* (2013.01);
(Continued)

(58) Field of Classification Search
CPC ..... C22C 38/58
See application file for complete search history.

(56) References Cited

FOREIGN PATENT DOCUMENTS

EP 3683324 A1 * 7/2020 ..... C21D 8/0205
GB 1574101 A * 9/1980 ..... C22C 38/42
(Continued)

OTHER PUBLICATIONS

PCT App. No. PCT/IB2021/061647; Search Report mailed Feb. 16, 2023.
(Continued)

*Primary Examiner* — Alexandra M Moore
(74) *Attorney, Agent, or Firm* — MARSHALL, GERSTEIN & BORUN LLP

(57) ABSTRACT

Austenitic stainless-steel made of steel having a composition in weight percentages, consisting of: traces≤C≤0.03%; 1.0%≤Mn≤2.0%; 0.8%≤Si≤2.0% %; preferentially 1.0%≤Si≤1.5%; traces≤Al≤0.06% %; traces≤P≤0.045%; traces≤S≤0.015%; 8.0%≤Ni≤12.0%; 17.5%≤Cr≤20.0%; 0.4%≤ Mo≤0.8%; traces≤Sn≤0.05%; traces≤Nb≤0.08%; traces≤V≤0.15%; traces≤Ti≤ 0.08%; traces≤Zr≤0.08%; traces≤Co≤1.0%; traces≤B≤0.01%; traces≤W+Mo≤0.8%; traces≤Pb≤0.03%; traces≤N≤0.1%; traces≤O≤0.01%; the rest being iron and impurities resulting from the production. Plates for heat exchangers, and chimney ducts, made of such steel.

16 Claims, 18 Drawing Sheets

Figure 1:
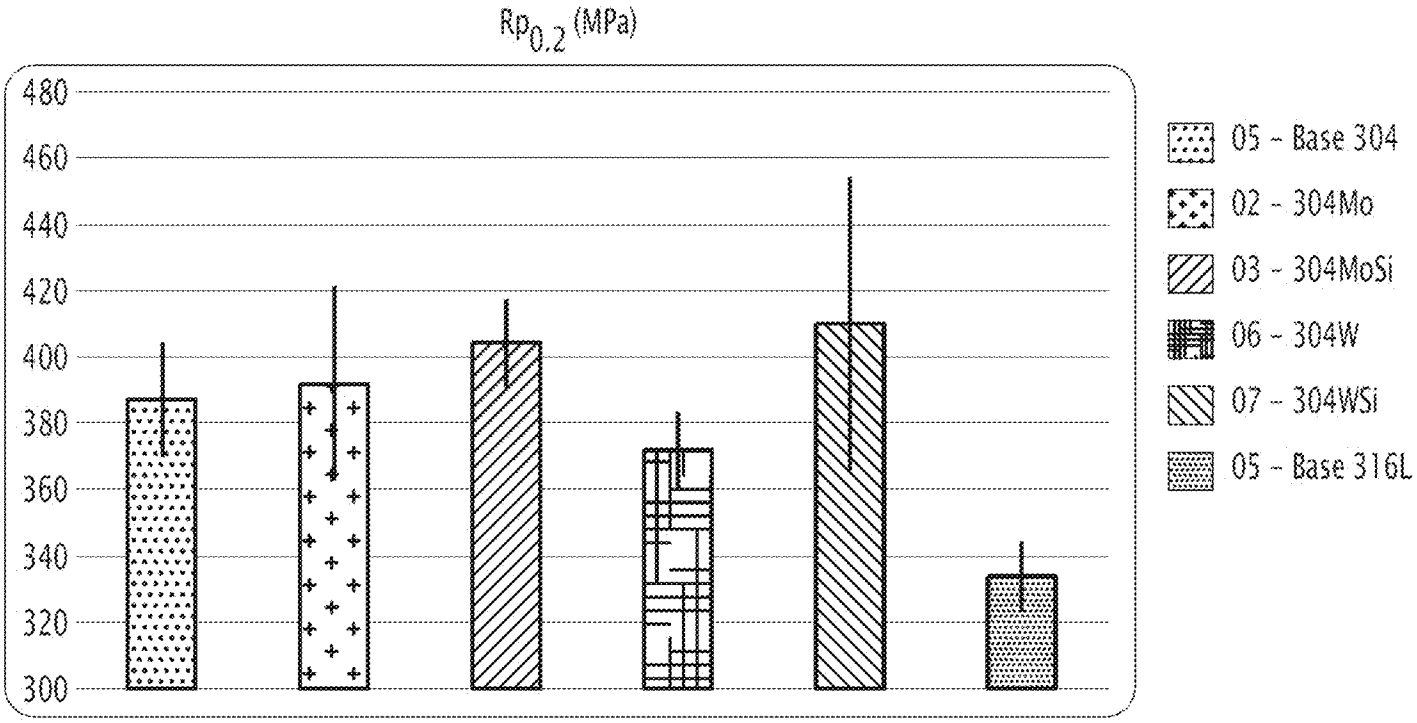

(51) Int. Cl.
*C22C 38/02* (2006.01)
*C22C 38/22* (2006.01)
*C22C 38/24* (2006.01)

(52) U.S. Cl.
CPC ..... *C22C 38/24* (2013.01); *C21D 2211/001* (2013.01)

(56) References Cited

FOREIGN PATENT DOCUMENTS

| | | | |
|---|---|---|---|
| JP | H09279313 | A | 10/1997 |
| KR | 20180074322 | A | 7/2018 |

OTHER PUBLICATIONS

PCT App. No. PCT/IB2020/062043; Search Report mailed May 20, 2021.

* cited by examiner

AUSTENITIC STAINLESS-STEEL, PLATES FOR HEAT EXCHANGERS, AND CHIMNEY DUCTS MADE WITH THIS STEEL

The present invention relates to the field of austenitic stainless-steels. More particularly, the invention relates to austenitic stainless-steels exhibiting a good compromise between a high resistance to different types of corrosion, a good formability and a moderate cost obtained by limiting as much as possible, the presence of expensive alloying elements such as Ni and Mo.

Preferred, but not exclusive applications would be the manufacture of heat exchanger plates, or chimney duct elements, which both require such excellent corrosion resistance, particularly at temperatures above the ambient temperature, and good formability.

Among the most commonly used austenitic stainless-steel grades is the grade called X5CrNi189 (1.4301) according to the standard EN10088-2, the standardized composition of which is given in percentages by weight, like all the chemical element contents given in the present text: C≤0.07%; Si≤1.0%; Mn≤2.0%; P≤0.045%; S≤0.015%; N≤0.11%; Cr=17-19.5%; Ni=8-10.5%. Said grade is comparable to the grade called "304" according to ASTM A240, with the difference that same limits Si to 0.75% and C to 0.08%.

Additions of Nb or Ti, on the order of 0.2% e.g., can contribute to improving the corrosion resistance of welds, in that same lead to the formation of Nb or Ti carbides instead of Cr carbides, thus preserving the amount of Cr in solution.

Another solution consists in lowering the carbon content in the steel, thus avoiding the precipitation of chromium carbides during cooling, which deteriorate the resistance to corrosion. The low carbon variant of X5CrNi18-9 (1.4301) becomes X2CrNi18-9 (1.4307) as per EN 10088-2 and 304 becomes "304L" as per ASTM A240.

The above grades have good resistance to corrosion which can nevertheless prove insufficient in particularly aggressive environments, e.g. maritime environments, and chlorinated environments in general.

In such contexts where particularly high resistance to different types of corrosion is sought, the X5CrNiMo17-12-2 grades according to EN 10088-2 and "316" as per ASTM A240 and the grades derived therefrom, are thus often preferred to the X5CrNi189 grade (1.4301) and 304 as per the same standards, respectively.

The typical standard composition of the X5CrNiMo17-12-2 is: C≤0.07%; Si≤1.0%; Mn≤2.0%; P≤0.045%; S≤0.015%; N≤0.1%; Cr=16.5-18.5%; Mo=2.0-2.5%; Ni=10-13%. The composition is comparable to the composition of the grade called "316" in the standard ASTM A240 with the difference that same limits Si to 0.75%, C to 0.08% and incorporates chromium between 16 and 18%. Compared with X5CrNi189, there is a shift in the Cr concentration range towards slightly lower minimum and maximum values, a concentration of Ni which, on the other hand, is most often higher, and above all, the significant presence of Mo.

As with the 18% chromium and 9% nickel grades, even higher performance in terms of resistance to corrosion in chlorinated media is achieved with the X2CrNiMo17-12-2 grade of usual standardized composition: C≤0.03%; Si≤1.0%; Mn≤2.0%; P≤0.045%; S≤0.015%; N≤0.1%; Cr=16.5-18.5%; Mo=2-2.5%; Ni=10-13%. The composition is thus distinct from X5CrNiMo17-12-2 mainly by a lower maximum concentration of C, which contributes to providing the composition with even better resistance to intergranular corrosion in a chlorinated medium than the composition of X5CrNiMo17-12-2, due to the lesser possibility of formation of Cr carbides and Cr carbonitrides. The above grade is also easier to weld. Such grade is comparable to the grade called "316L" in ASTM A240.

X5CrNiMo17-12-2 grades and the known derivatives thereof have the disadvantage of being more expensive than X5CrNiMo17-12-2. due to the higher concentrations of Ni and to the significant presence of Mo. Also, the extraction of such elements from the ore thereof is harmful to the environment. It would therefore be interesting to find suitable substitutes for said grades with a lower concentration of expensive, high ecological impact alloying elements. Such is the goal of the present invention.

To this end, the subject matter of the invention is an austenitic stainless-steel, characterized in that the composition thereof, in percentages by weight, consists of:

traces≤C≤0.03%;
1.0%≤Mn≤2.0%;
0.8%≤Si≤2.0%; preferentially 1.0%≤Si≤1.5%;
traces≤Al≤0.06%; preferentially traces≤Al≤0.01%;
traces≤P≤0.045%;
traces≤S≤0.015%;
8.0%≤Ni≤12.0%; preferentially 9.45%≤Ni≤10.0%;
17.5%≤Cr<20.0%;
0.4%≤Mo≤0.8%; preferentially 0.5%≤Mo≤0.6%;
traces≤Sn≤0.05%;
traces≤Nb≤0.08%;
traces≤V≤0.15%;
traces≤Ti≤0.08%;
traces≤Zr≤0.08%;
traces≤Co≤1.0%;
0.02%≤Cu≤0.6%;
traces≤B≤0.01%;
traces≤W+Mo≤0.8%;
traces≤Pb≤0.03%;
traces≤N<1000 ppm;
traces≤O≤0.01%; preferentially traces≤O≤0.005%;
the rest being iron and impurities resulting from the production.

Also disclosed is an austenitic stainless-steel, characterized in that the composition, in weight percentages, consists of:

traces≤C≤0.03%;
1.0%≤Mn≤2.0%;
0.8%≤Si≤2.0%; preferentially 1.0%≤Si≤1.5%;
traces≤Al≤0.06%; preferentially traces≤Al≤0.01%;
traces≤P≤0.045%;
traces≤S≤0.015%;
8.0%≤Ni≤12.0%; preferentially 9.45%≤Ni≤10.0%;
17.5%≤Cr≤20.0%;
0.4%≤Mo≤0.8%; preferentially 0.5%≤Mo≤0.6%;
traces≤Sn≤0.05%;
traces≤Nb≤0.08%;
traces≤V≤0.15%;
traces≤Ti≤0.08%;
traces≤Zr≤0.08%;
traces≤Co≤1.0%;
traces≤B≤0.01%;
traces≤W+Mo≤0.8%;
traces≤Pb≤0.03%;
traces≤N≤0.1%;
traces≤O≤0.01%;
the rest being iron and impurities resulting from the production.

The average grain size thereof can be comprised between 11 and 6 ASTM.

A further subject matter of the invention relates to a plate for a heat exchanger, characterized in that the plate is made of such austenitic stainless-steel.

A further subject matter of the invention relates to an element of a chimney duct, characterized in that same is made of such austenitic stainless-steel.

As will have been understood, the invention is based on a modification of the composition of the classic grade X2CrNi18-9 by carefully balanced additions of Mo and Si, the Mo content remaining relatively low. Such additions tend to bring the steel closer to the composition of X2CrNiMo17-12-2, due to the presence of Mo. But the additions do not correspond to a variant of said nuance which would have been known so far, or which would have been obvious, especially because the presence of Mo remains relatively moderate. Such modification is thus not economically detrimental, and is nevertheless sufficient, in combination with the concentration of Si which can be higher than in X2CrNi18-9 and X2CrNiMo17-12-2, for maintaining both mechanical properties and properties of resistance to corrosion which would be at least as good as the properties of CrNiMo17-12-2. Such properties are well suited to applications requiring both high resistance to different types of corrosion and good formability for producing thin parts and parts with complex shapes, such as e.g. heat exchanger elements or chimney ducts.

The inventors concluded that the following steel composition, expressed in % by weight, was best suited for solving the aforementioned problems in terms of cost of materials, mechanical properties and performance against corrosion.

The concentration of C is comprised between traces and 0.030%. C is a highly gamma-stabilizing (austenitizing) element, and an excessive concentration of C would lead to having to compensate for such concentration by adding expensive alpha-stabilizing (ferritizing) elements such as Cr or Mo. Moreover, C is highly unfavorable to the intergranular resistance to corrosion and strongly reduces the ability of the grade to be welded.

The concentration of Mn is comprised between 1.0% and 2.0%. Mn provides the stability of austenite by reducing the propensity thereof to convert into martensite, under stress or thermally, and consequently increases the ability to deform thereof and becomes less prone to strain hardening, which is greatly appreciated during the deep-drawing of heat exchanger plates. However, at high concentration tends to reduce the resistance to corrosion of the grade, and the concentration thereof has to be limited herein to 2.0%.

The concentration of P is at most 0.045%.

The concentration of S is at most 0.015%.

S and P are extremely harmful elements for the resistance to corrosion of stainless grades and also strongly reduce the mechanical strength thereof and the ability to deform thereof when hot. The concentrations thereof should preferentially be as low as possible, and in any case less than or equal to the limits mentioned.

The concentration of Si is comprised between 0.8% and 2.0%, and preferentially between 1.0% and 1.5%. According to the invention, said element when combined with a moderate concentration Mo content, significantly increases the resistance to corrosion of the grade. Si is also a highly alpha-stabilizing (ferritizing) element, and the concentration thereof has to be limited to 2%, otherwise the grade would be unbalanced, and the high concentration of Si would have to be compensated for by the presence of a gamma-stabilizer element, such as the expensive Ni or the harmful C.

Also, the fact of reducing the concentration of Mo compared to the previously used grades, by replacing Mo with Si, reduces the ecological impact of obtaining the necessary raw materials.

The concentration of Al is comprised between traces resulting from the production and 0.06%. Al can be used by steelmakers as a deoxidizer. But if Al is poorly controlled, same can affect the inclusionary cleanliness of the steel, and especially the final appearance of the surface of the product. Al is also an alpha-stabilizing element the excessive presence of which would require to be compensated by an expensive gamma-stabilizing element such as Ni or detrimental to resistance to corrosion properties such as C. It is hence important to limit the concentration of Al to at most 0.06%, and preferentially to at most 0.01%.

Ni is a powerful gamma-stabilizing element and increases the deformability and resilience of the steel grades considered. However, Ni is also relatively expensive and the concentration thereof has to bring about a balance between the metallurgical stability of the grade and the cost thereof. Thus, a too low concentration of Ni (less than 8.0%) would lead to an unstable grade with the formation of martensite during deformation leading to a significant increase in mechanical strength (strain hardening) and a decrease in elongation at break. However, a too high concentration would lead to an economically uncompetitive grade. According to the invention, the concentration of Ni is comprised between 8.0% and 12.0%, preferentially between 9.45% and 10.0%.

Cr is the fundamental element for the production of stainless-steel. The concentration of Cr gives the steel most of the resistance to corrosion thereof. For the applications targeted by the invention and in order to impart to the steel, the austenitic metallurgical state thereof, Cr has to be comprised between 17.5% and 20.0%.

The concentration of Mo is comprised of between 0.4% and 0.8% and preferentially between 0.5% and 0.6%. Mo is an element which increases resistance to corrosion by reinforcing the passive film which spontaneously forms on the surface of a stainless-steel. According to the invention, the addition of Mo, carefully adjusted and combined with a precise range of concentrations of Si, significantly increases the properties of resistance to corrosion of an austenitic steel without having to increase the concentration of Mo to levels such as the levels present in the grade X2CrNiMo17-12-2. The concentration of Mo required by the invention has also to take into account the possible presence of W, as will be discussed hereinafter.

The concentration of Sn is limited between traces resulting from the production and 0.05%, with Sn strongly reducing the ability to be forged hot.

The concentrations of Nb, Zr and Ti are comprised between traces resulting from the production and 0.08%. Such stabilizing elements with respect to intergranular corrosion are not necessary herein, due to the low concentration of C which is imposed according to the invention. Preferentially, the concentration of Nb is strictly less than 0.03% and better less than 0.02%.

The concentration of V content is between traces resulting from the production and 0.15%. V increases the solubility of N in austenite at high temperatures, and can be added, moderately to the grade so as to prevent any precipitation of chromium nitrides. Preferentially, to improve the ability to be forged, the concentration of V is greater than or equal to 0.03%, preferentially greater than or equal to 0.04%.

The concentration of Co is comprised between traces resulting from the production and 1.0%. Although Co is a gamma-stabilizing element which, as a result, could have metallurgical advantages, Co is excessively expensive and should be limited to 1.0% in order not to drastically degrade the cost of the grade.

B is known to increase the ability to be forged and the creep of steels. The concentration thereof is comprised between traces resulting from the production and 0.01%.

W is described in the scientific literature as being used for increasing the resistance to corrosion of the grade in proportions equivalent to the proportions of Mo. However, W is an excessively expensive element the significant presence of which would drastically increase the cost of the grade. W should thus be restricted to a maximum value depending on the proportion of Mo and satisfying the law Mo+W≤0.8%, and preferentially reduced to the state of traces resulting from the production.

Cu is present in the composition as an impurity resulting from the production, in a content which should remain at most 0.6%, generally less than or equal to 0.5%, better less than 0.3%. The concentration of Cu is at least 0.02%, or, depending on the production process, at least 0.10%.

The concentration of Pb is comprised between traces resulting from the production and 0.03%.

The concentration of N is comprised between 2.0% and 0.1% by weight (1000 ppm). Such a concentration leads to preventing a degradation of the mechanical properties which would be induced by higher concentrations. Preferentially, the concentration of N remains at most 0.08% (800 ppm). The concentration of N is generally greater than or equal to 0.03% (300 ppm).

The concentration of O is comprised between traces and 0.01%, and preferentially limited to a concentration as low as possible, in order to satisfy an inclusionary cleanliness in line with the main applications targeted.

The elements not mentioned are present only in trace amounts resulting from the production. The term "trace" should generally be understood as meaning that the elements are not added voluntarily during the production, or that (which might be the case with Al and other deoxidizing elements such as Zr) the elements are then removed, e.g. by decanting the non-metallic inclusions that the elements have formed, and are only very marginally present in the final steel.

It should be understood that the preferential ranges relating to different elements, given in the definition of the steel according to the invention, are independent of one another. In other words, it would remain conforming to the invention for the composition of the steel to lie, for certain elements, within the most general range thereof defined above, and for other elements within the preferred range thereof.

The average grain size can be comprised between 11 and 6 ASTM. The 6 ASTM size is preferred for applications wherein complex geometries, such as heat exchanger plates, need to be produced by deep-drawing, and the ASTM 11 size is preferred in cases where the heat exchanger is brazed or welded by diffusion welding at high temperatures. this way it is possible to provide a mechanical strength to the heat exchanger, after the assembly operation, in line with the high pressures withstood in service.

Figure 2:
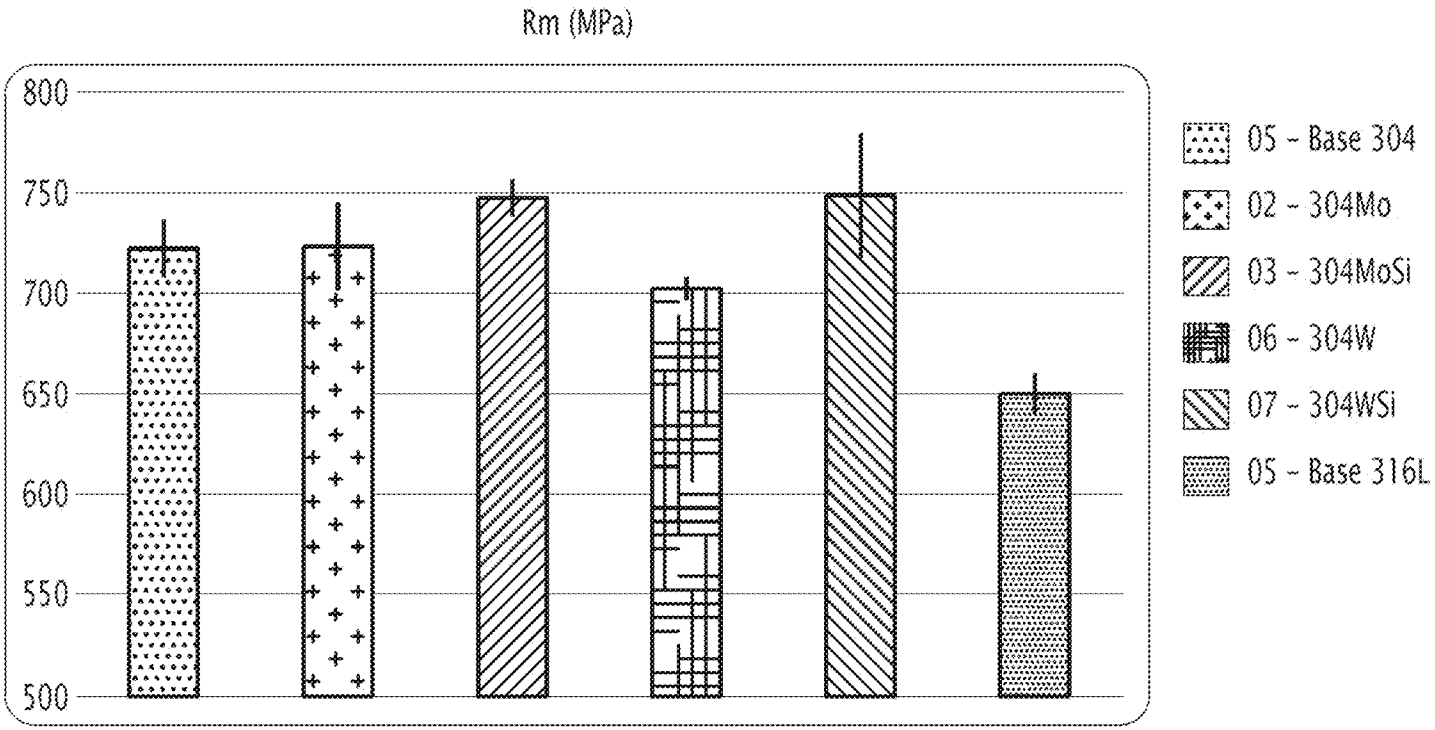
Figure 3:
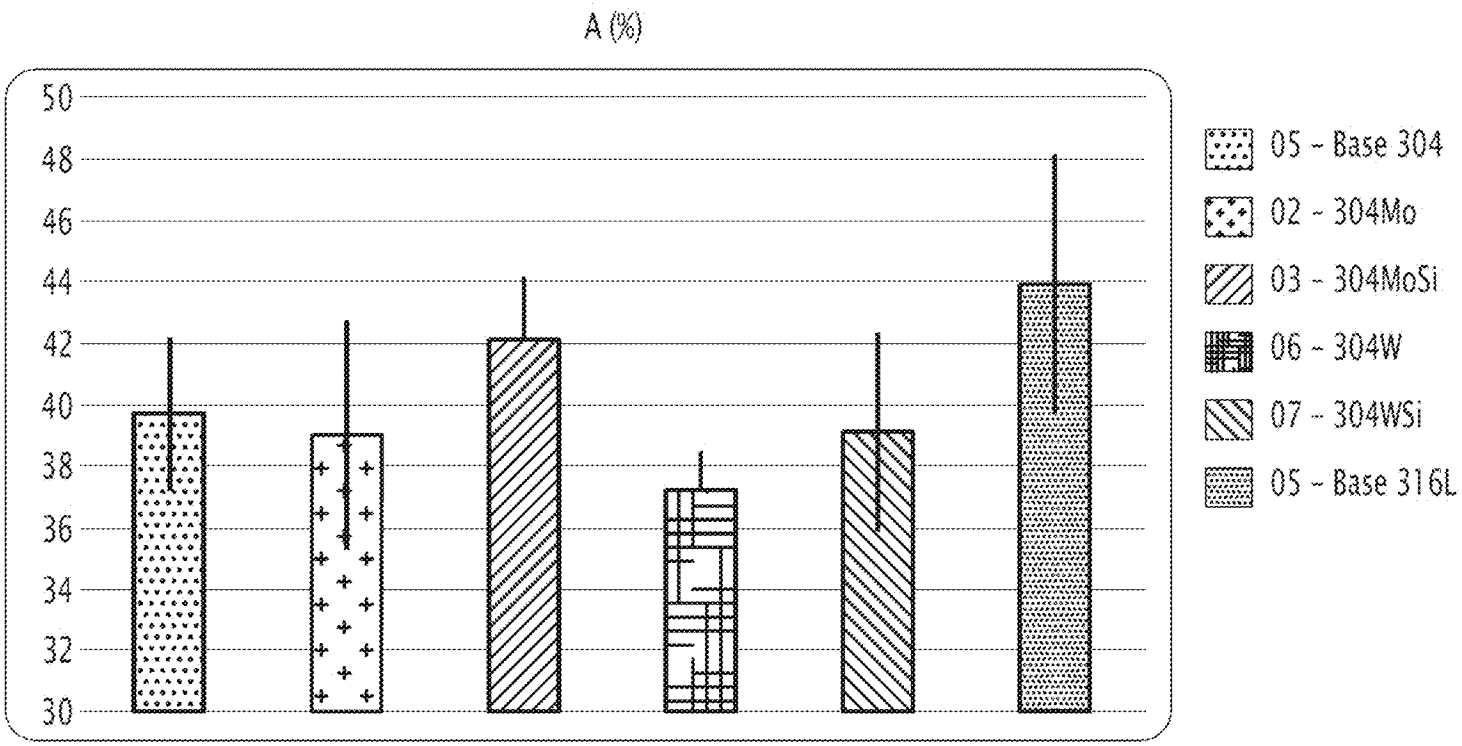
Figure 4:
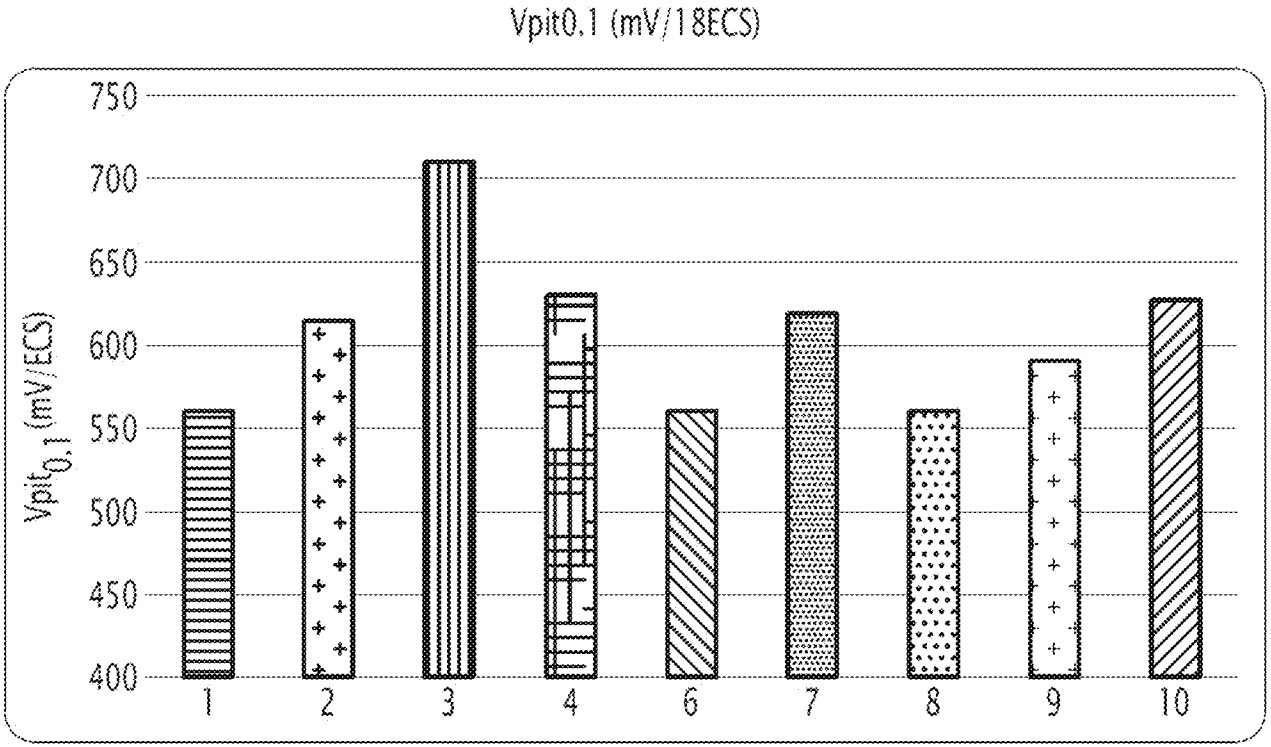
Figure 5:
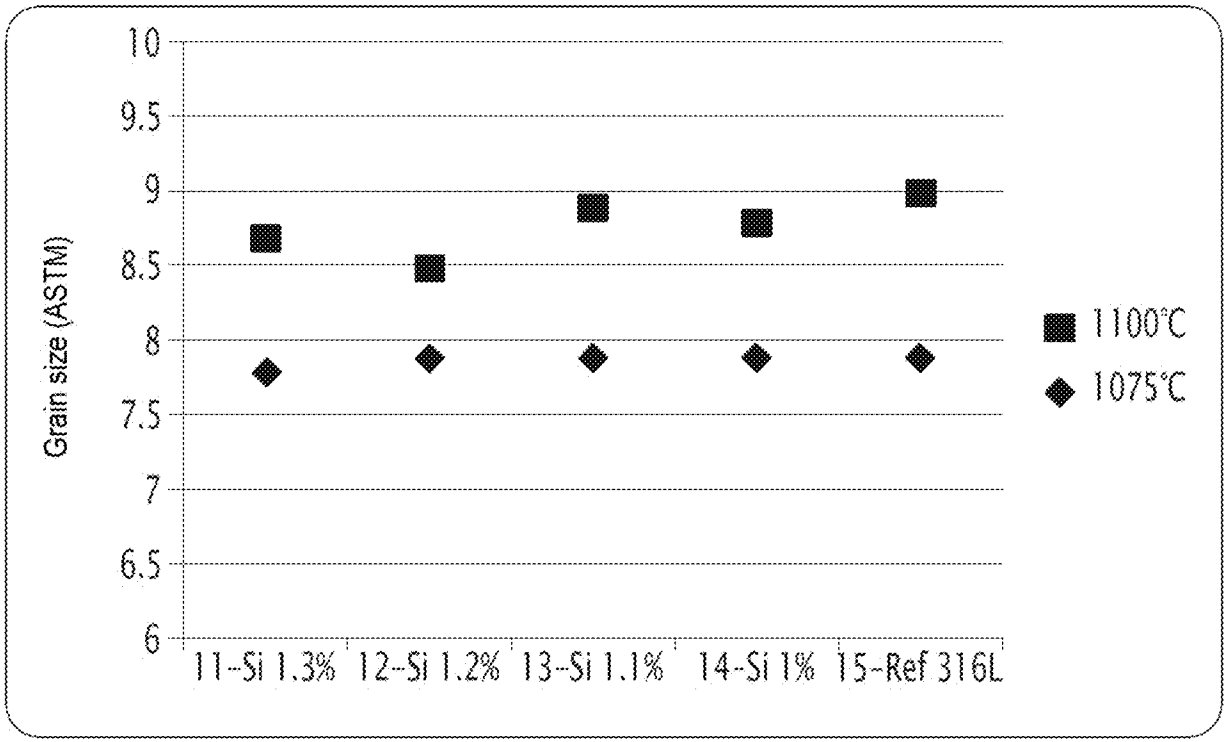
Figure 6:
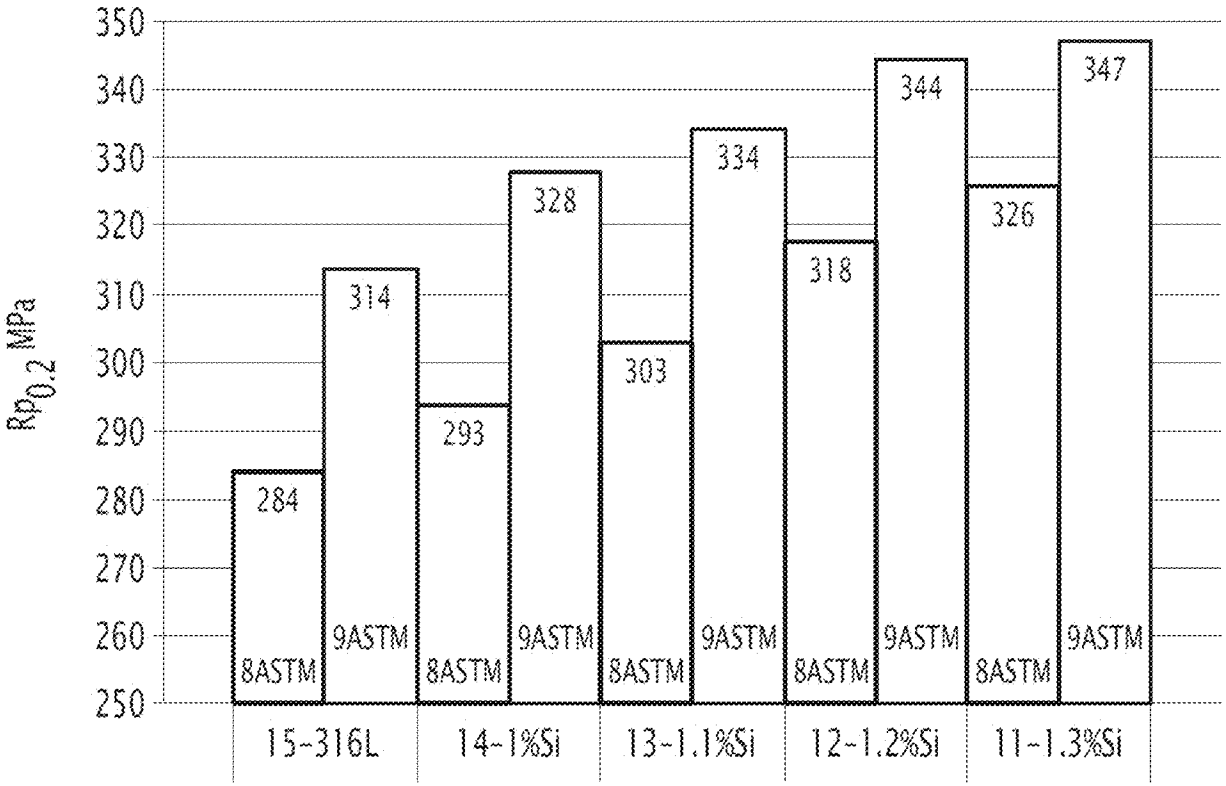
Figure 7:
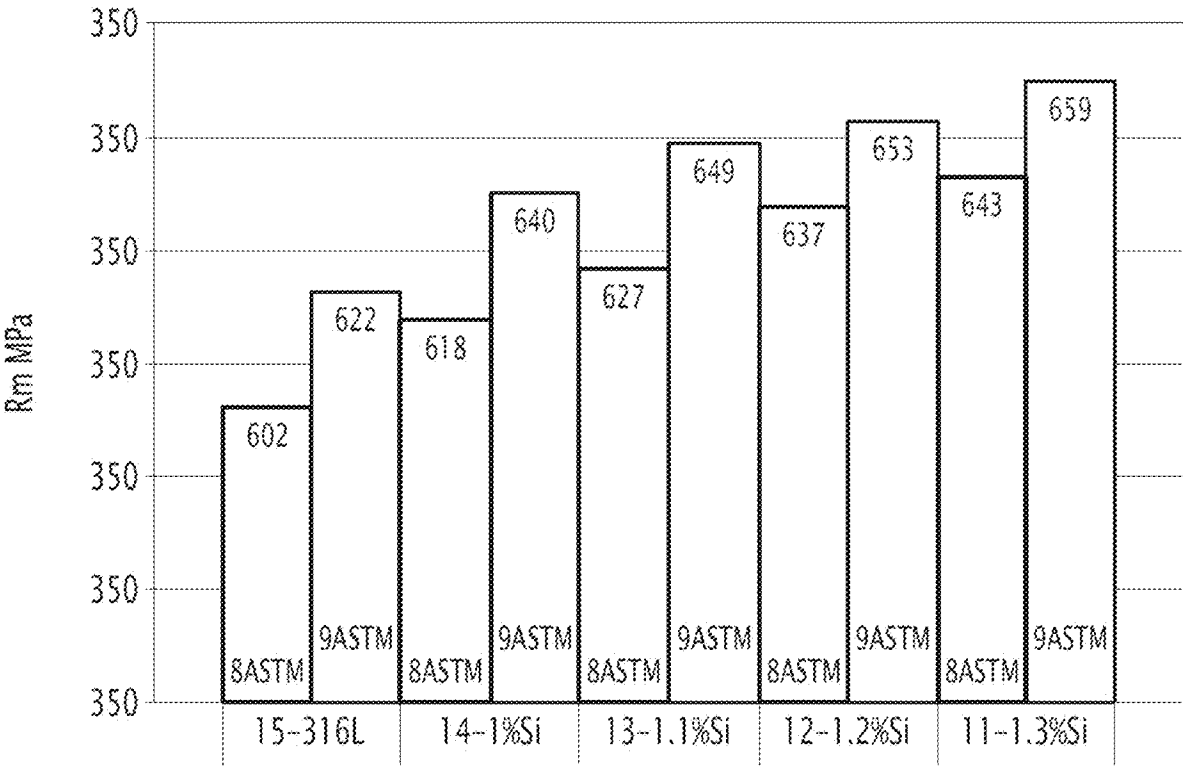
Figure 8:
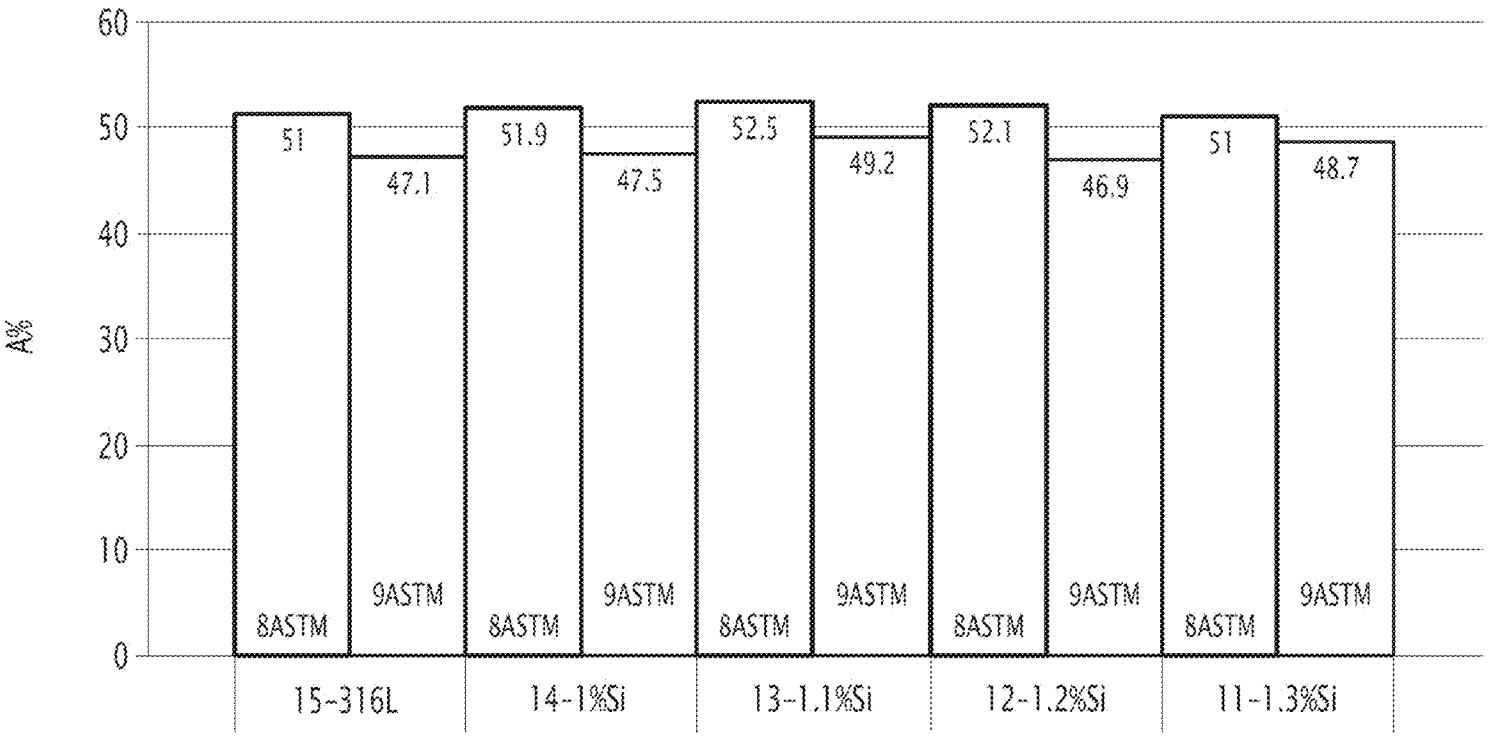
Figure 9:
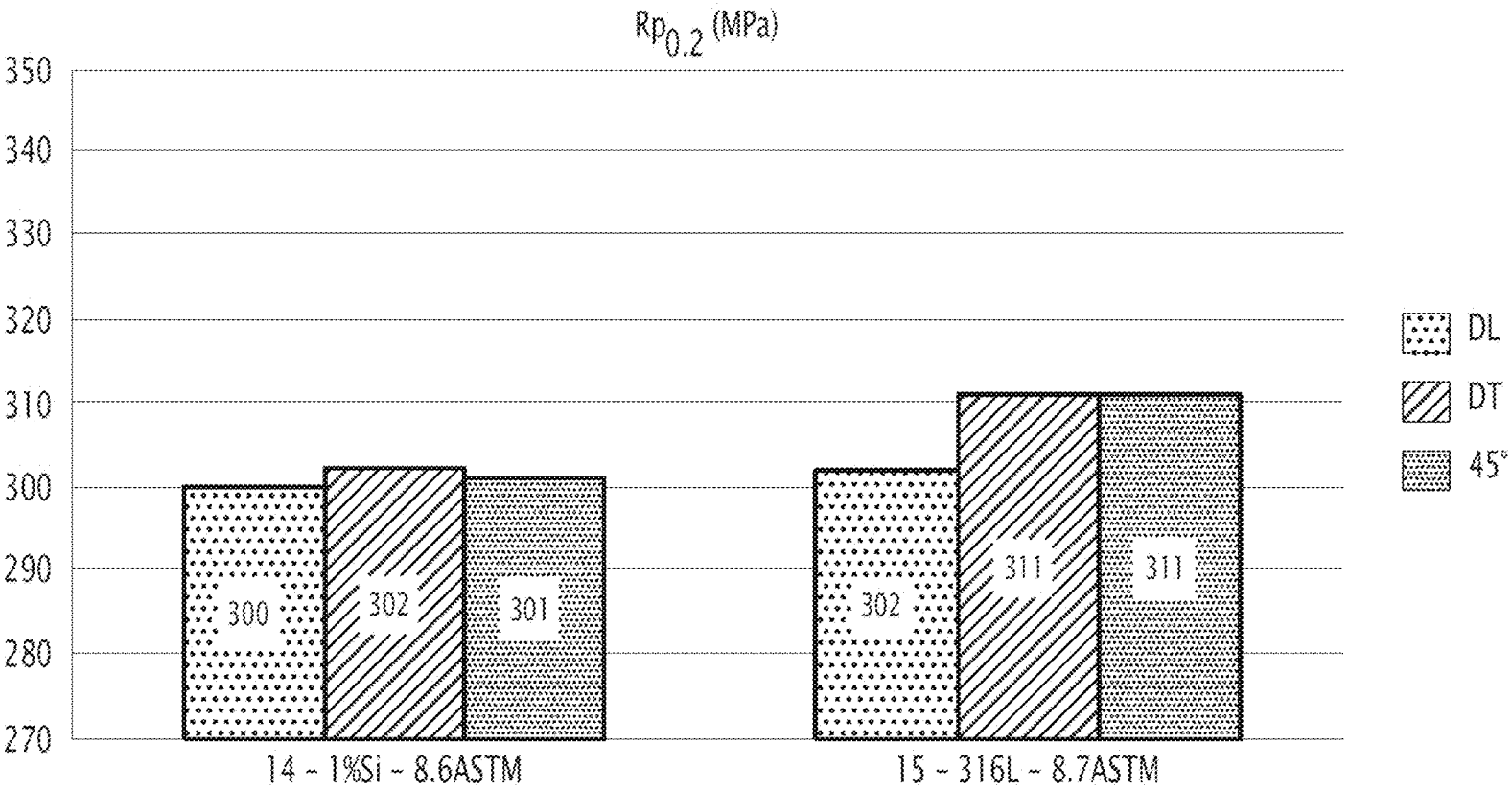
Figure 10:
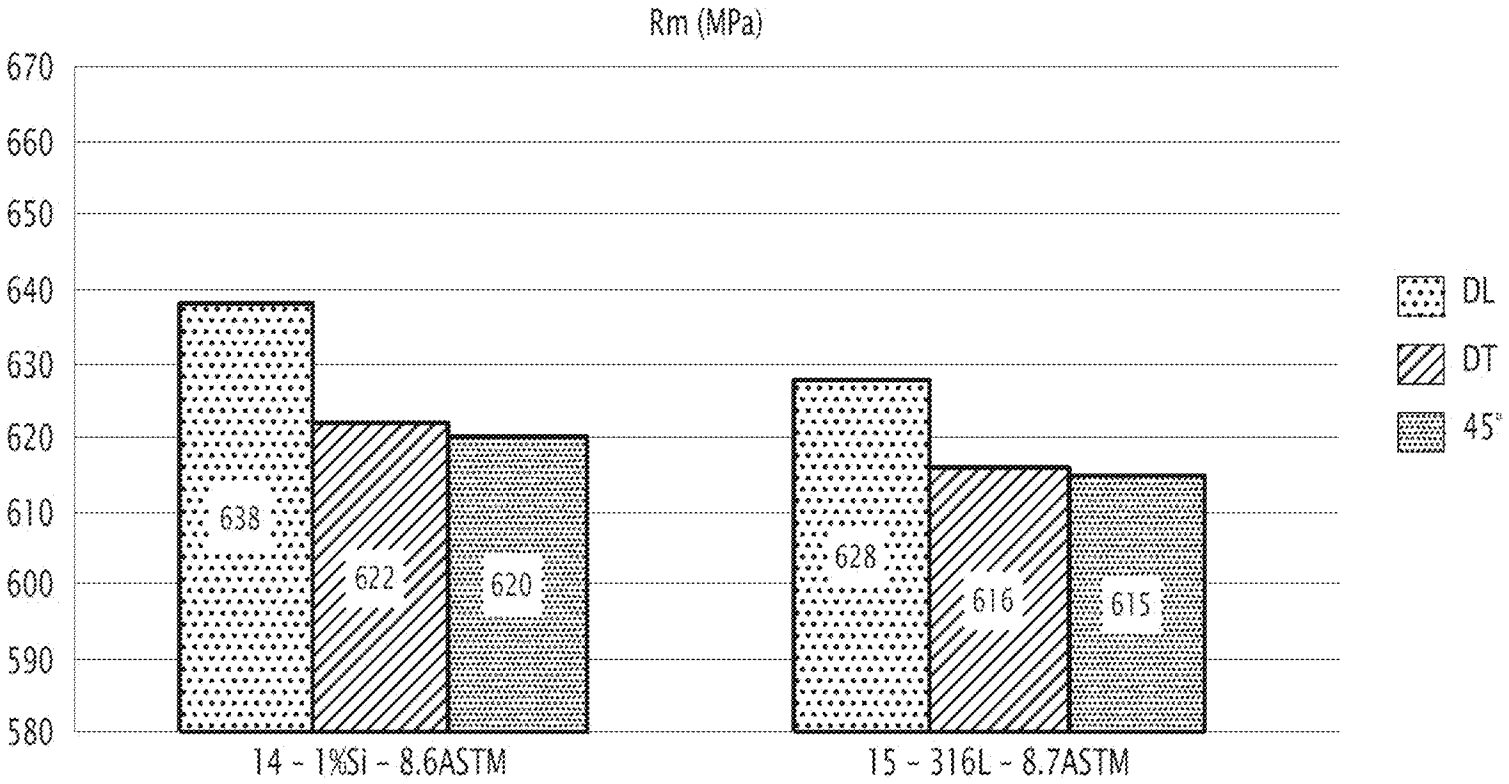
Figure 11:
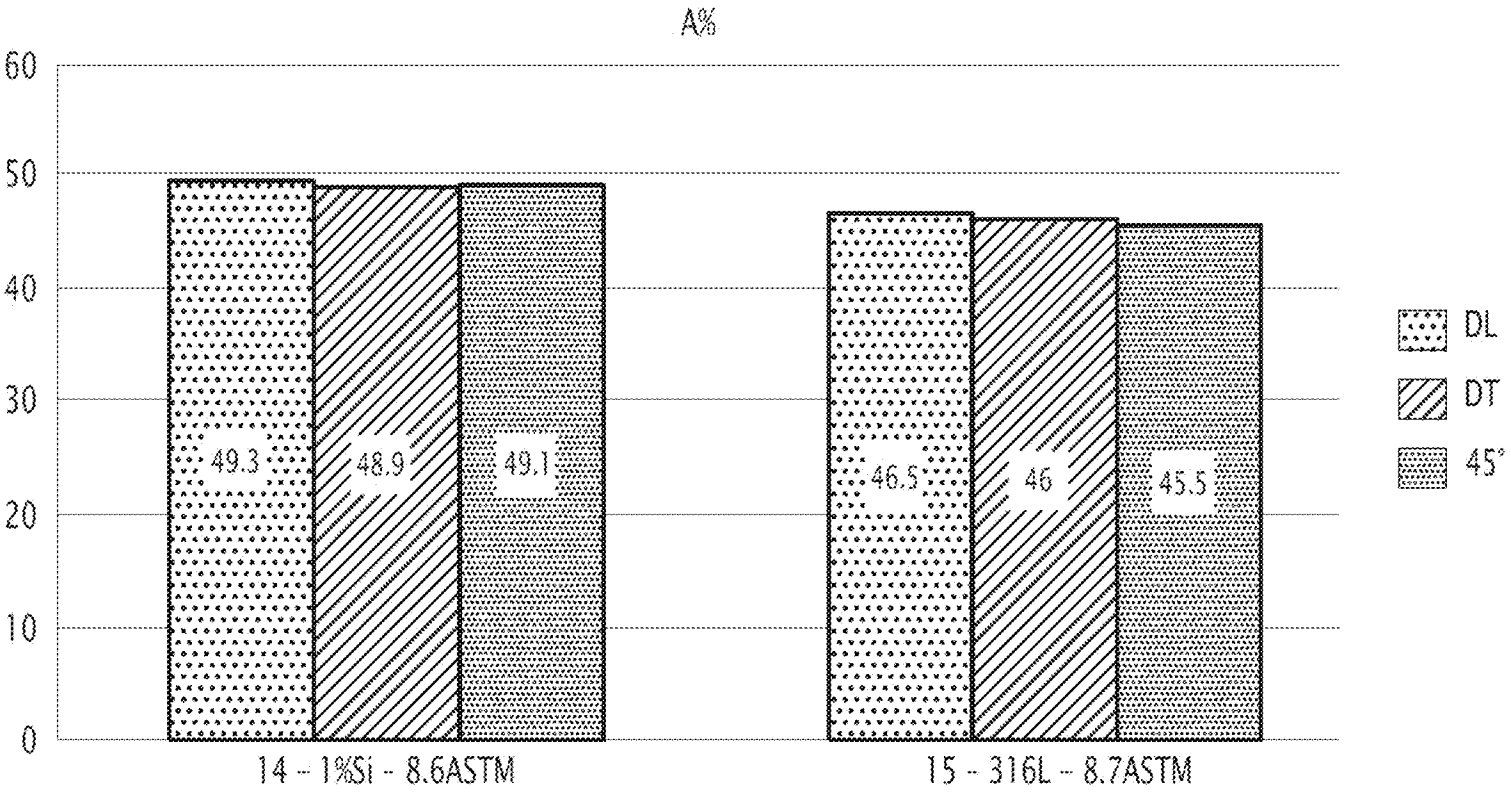
Figure 12:
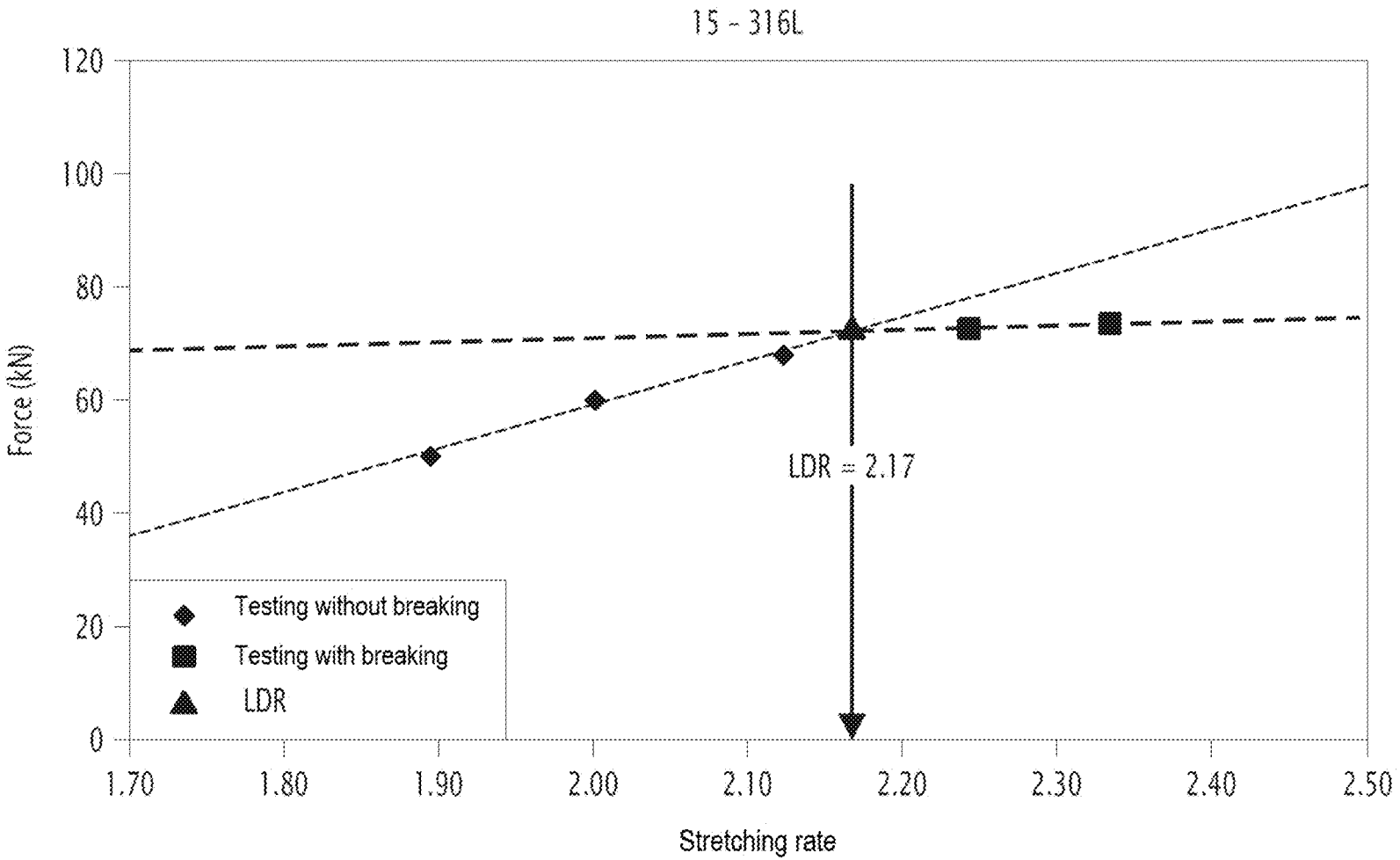
Figure 13:
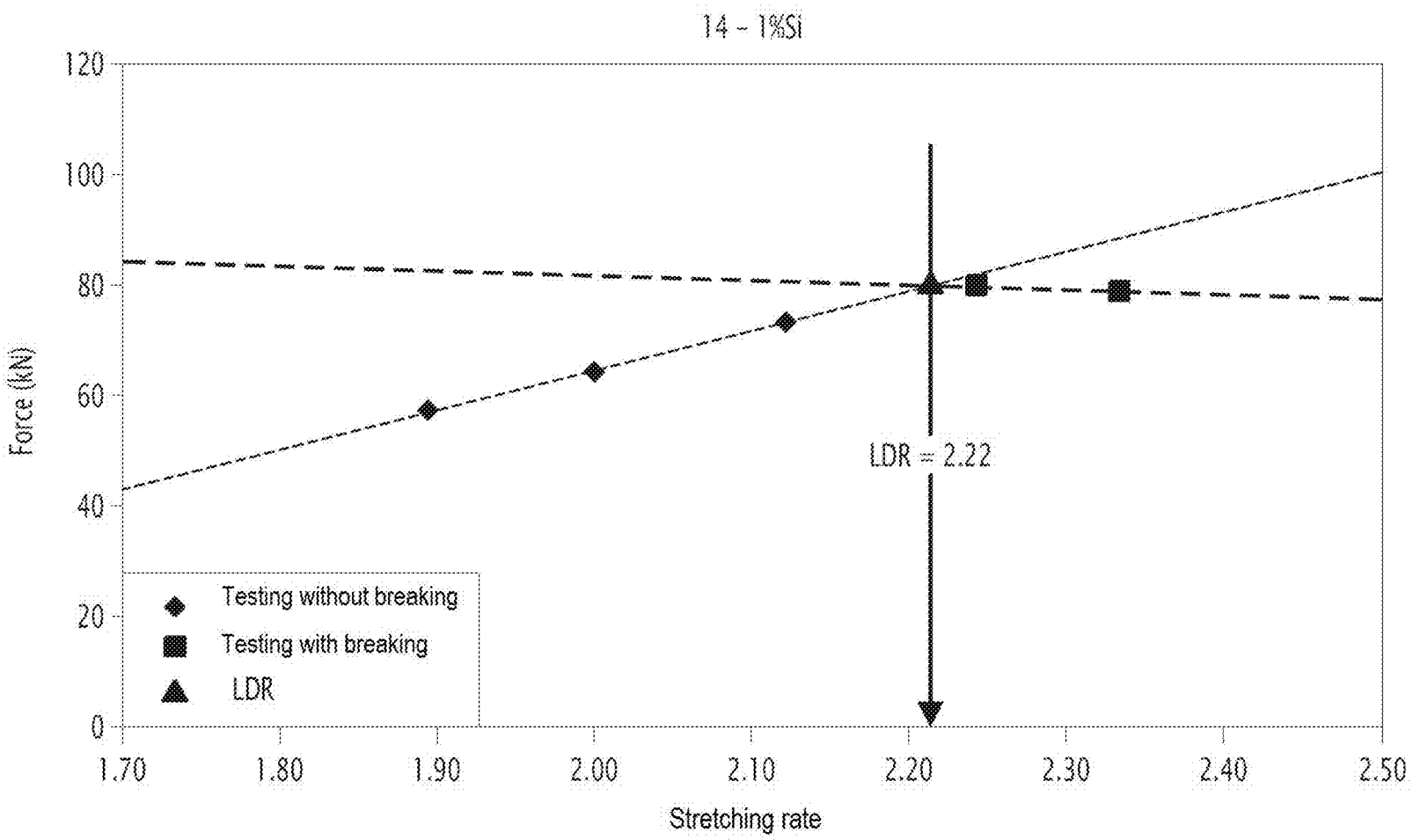
Figure 14:
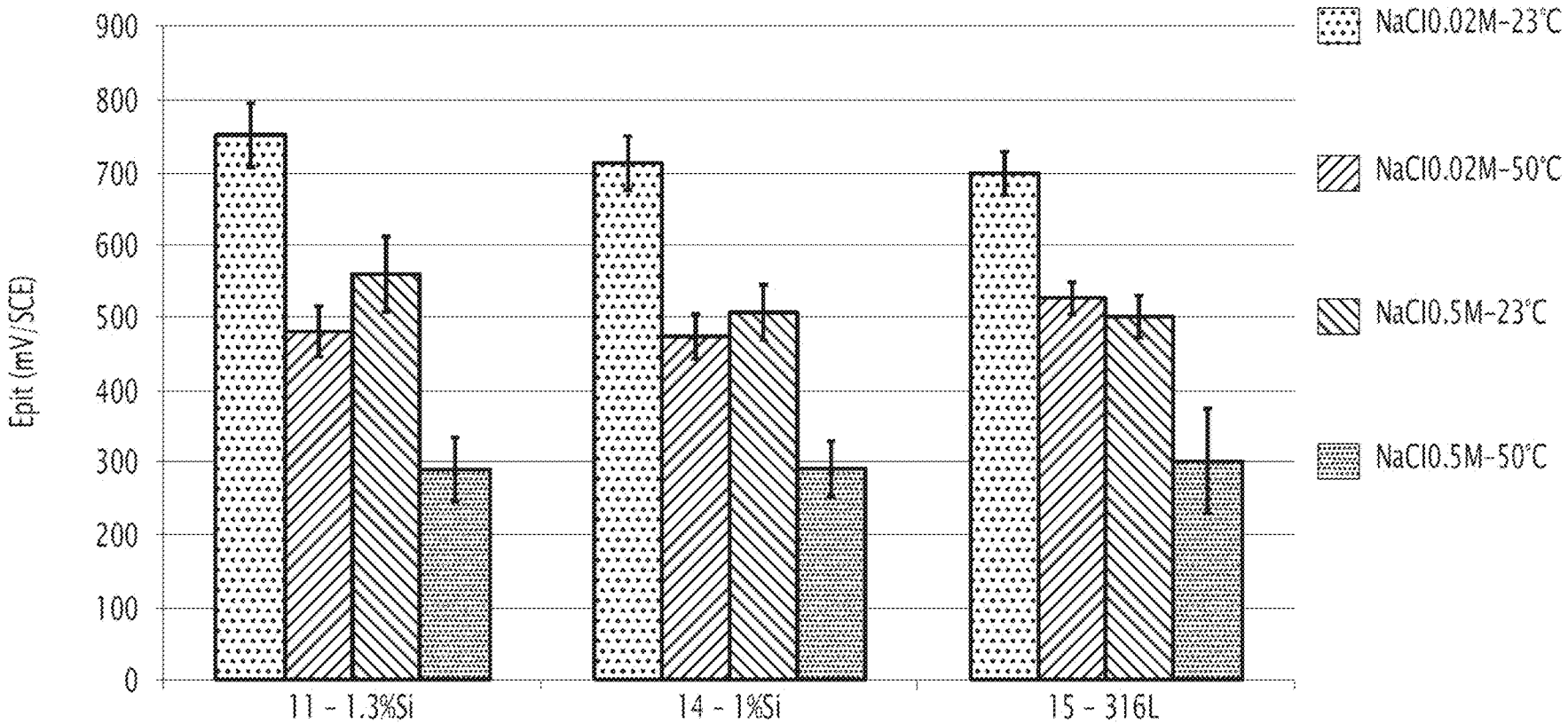
Figure 15:
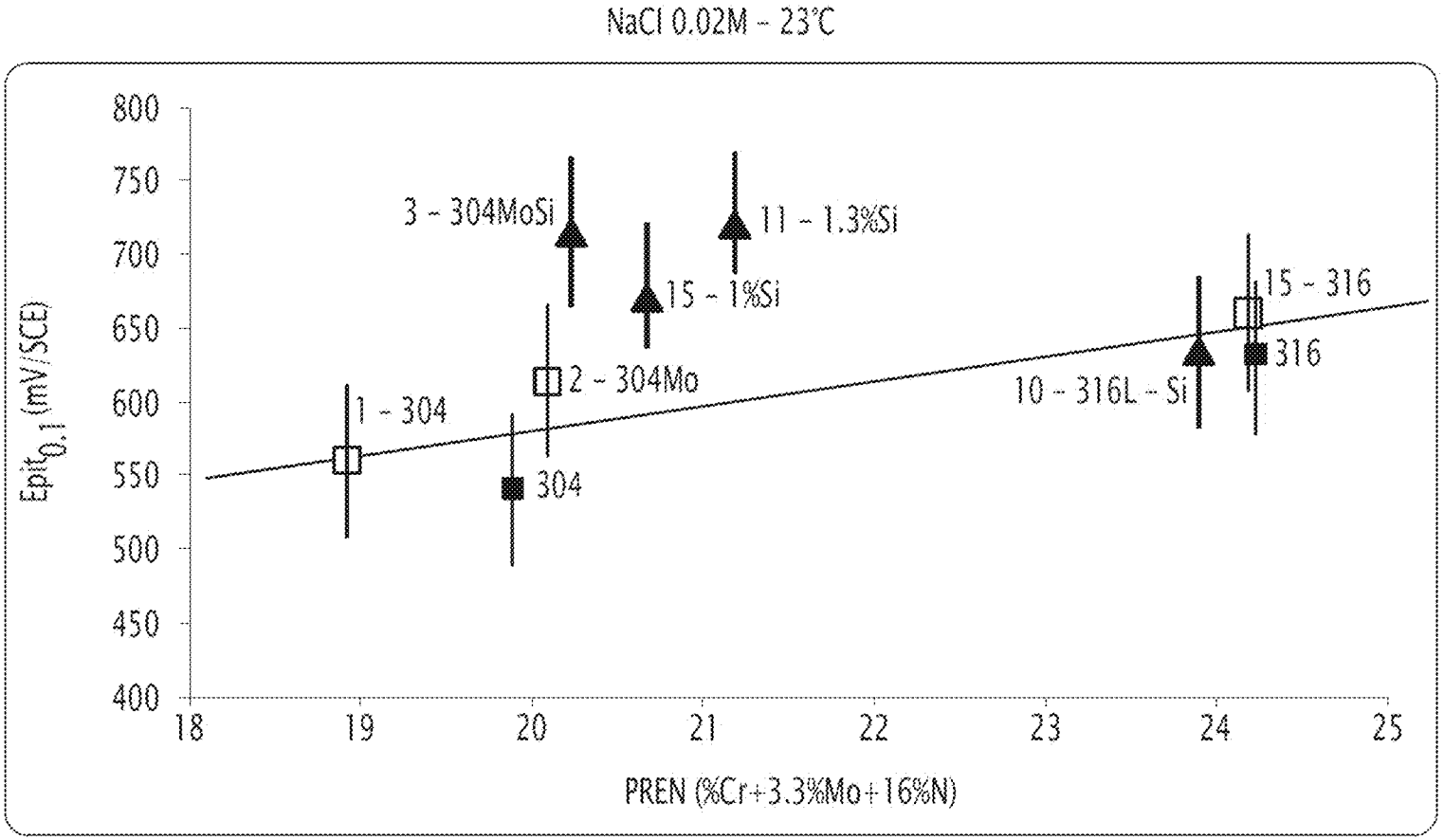
Figure 16:
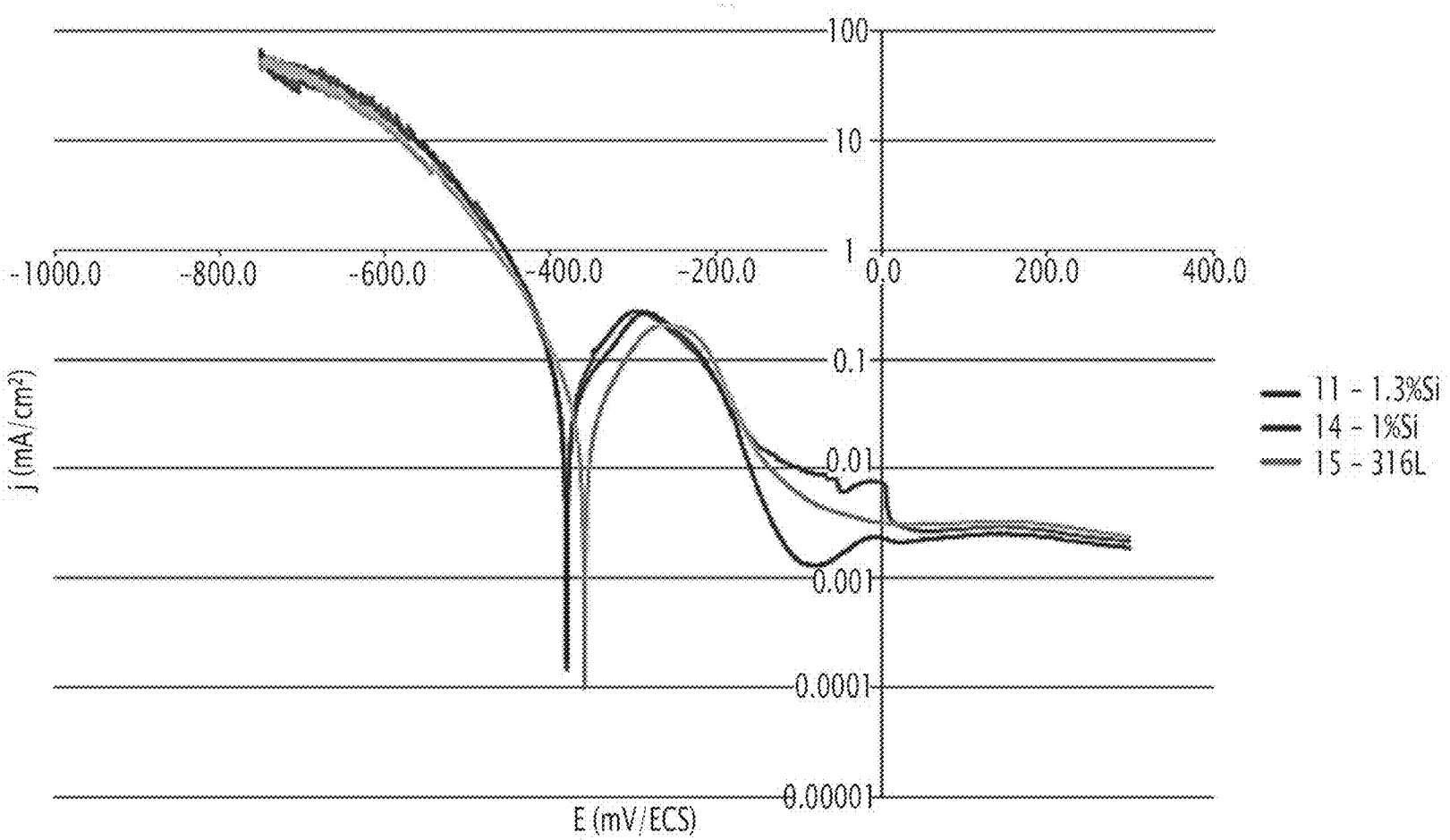
Figure 17:
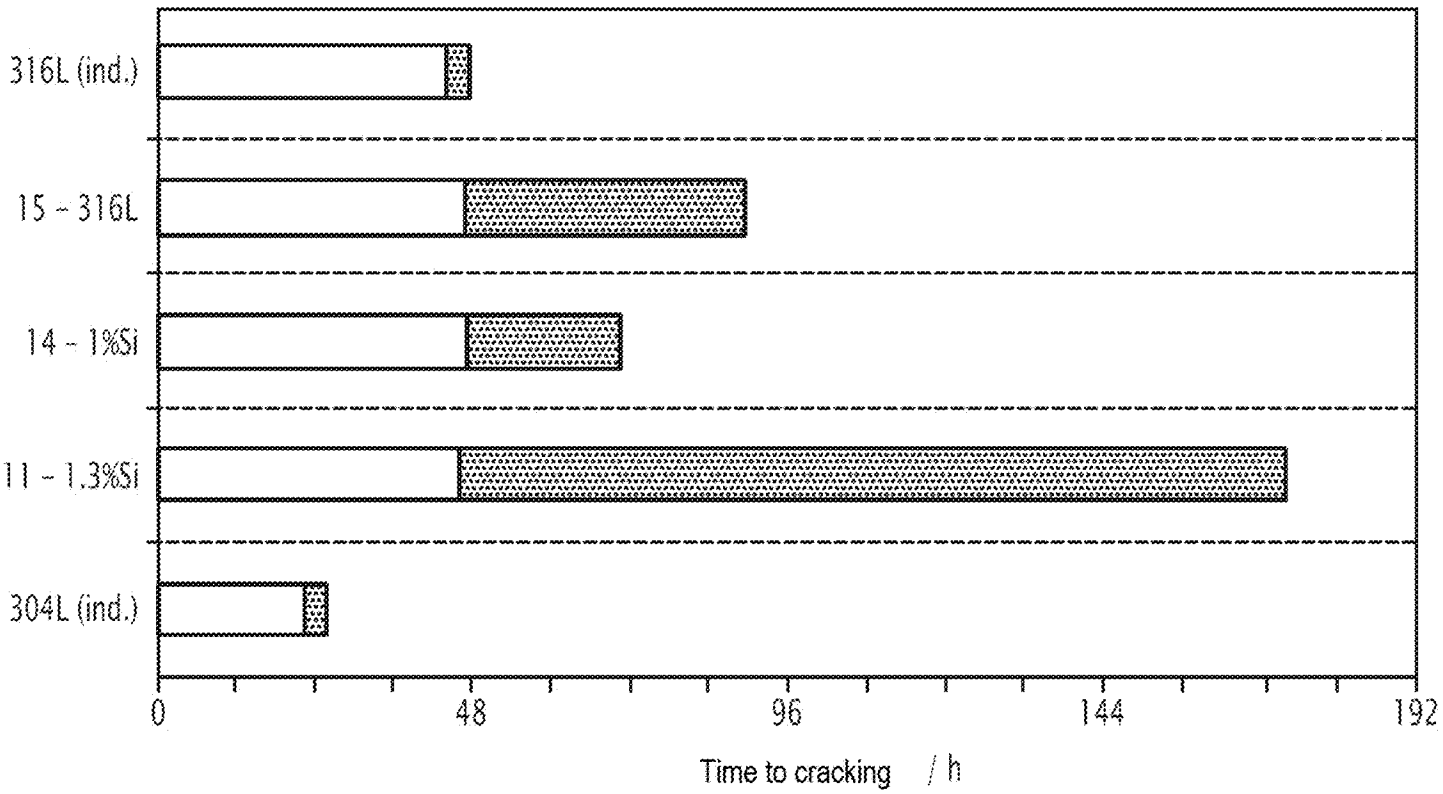
Figure 18:
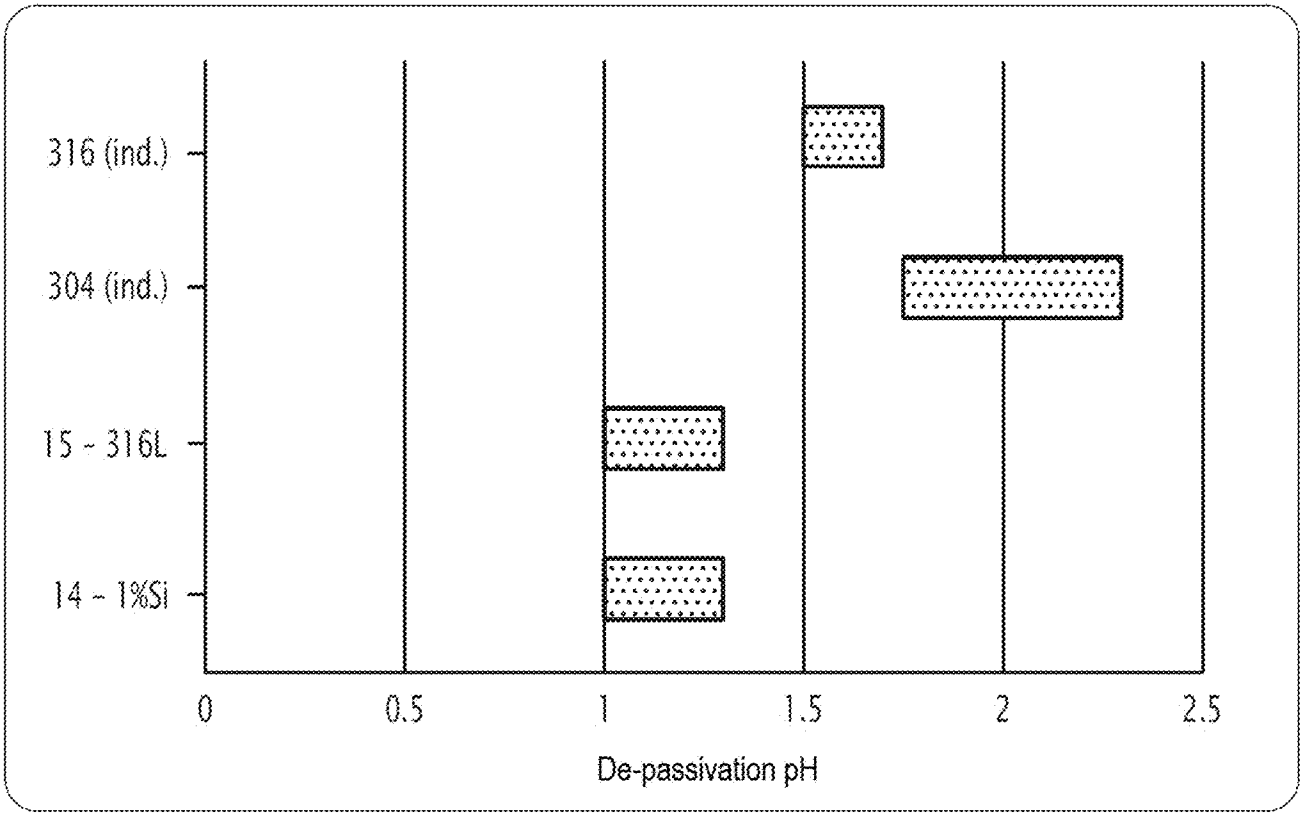

The invention will be better understood upon reading the following description, given as reference to the following enclosed drawings:

FIG. 1 which shows the conventional yield strength $Rp_{0.2}$ measured on a first series of different samples tested;

FIG. 2 which shows the tensile strength Rm measured on a first series of different samples tested;

FIG. 3 which shows the elongation at break A % measured on a first series of different samples tested;

FIG. 4 which shows the pitting corrosion potential $E_{pit}$ of different steels tested, measured in a 0.02M NaCl medium at 23° C.;

FIG. 5 which shows the grain sizes of various steels tested for two different annealing temperatures;

FIG. 6 which shows the results of measuring the conventional yield strength $Rp_{0.2}$ for the same steels;

FIG. 7 which shows the results of the measurement of the tensile strength Rm for the same steels;

FIG. 8 which shows the results of measurement of elongation at break A % for the same steels;

FIG. 9 which shows the conventional yield strength $Rp_{0.2}$ measured in tensile tests along three directions on two of the steels;

FIG. 10 which shows the results of measuring the tensile strength RM along three directions on two of the steels;

FIG. 11 which shows the results of measurement of elongation at break A % along three directions, on two of the steels;

FIGS. 12 and 13 which show, for a reference steel and for a steel according to the invention, respectively, the limit deep-drawing ratio LDR;

FIG. 14 which shows, for two steels according to the invention and one reference steel, the influence of salinity and temperature of an aqueous NaCl solution on resistance to pitting corrosion;

FIG. 15 which shows, for various steels tested, the influence of PREN on the resistance to pitting corrosion;

FIG. 16 which shows, for two steels according to the invention and one reference steel, the current-voltage curves used for evaluating the sensitivity of the steels to uniform corrosion;

FIG. 17 which shows, for two steels according to the invention and three reference steels, the results of drop evaporation testing for evaluating the resistance thereof to stress corrosion;

FIG. 18 shows the results of depassivation pH measurements for a steel according to the invention and for three reference steels;

We first carried out comparative tests on steels of various compositions, in order to find the right balance between the concentrations of the different elements Si, Mo, W, Cu which were a priori likely to have an enhancing influence on the resistance to corrosion of the classic X2CrNi18-9 grade, due to the nobility thereof or to the stoichiometry thereof, alone or in combination. The steels were used for differentiating the respective influences of all the chemical elements on various properties of such grade, such as the ability to be forged hot, the stability of austenite, the resistance to corrosion etc. A classic X2CrNiMo17-12-2 was also incorporated into the tests for comparison, and an X2CrNiMo17-12-2 enriched in Si which could appear, at first glance, as a possible solution for improving the properties of such basic grade, in conjunction with the presence of 2.0% Mo.

The different compositions tested are summarized in Table 1, expressed as % by weight. It should be understood that the elements not mentioned in the table (as in the other tables in the present text describing steel compositions) are present only in the form of traces resulting from the production, with no metallurgical influence.

The names given to the different grades in Table 1 are not standardized; the names apply only within the specific framework of the present text and should be understood as corresponding to a X5CrNi18-9 steel, in the reference cases to 304 or X2CrNiMo17-12-2, in the reference cases to 316L to which the element(s) mentioned in the name have been significantly added and which place the steel outside the standards governing the composition of X5CrNi18-9 or X2CrNiMo17-12-2.

TABLE 1

Chemical compositions of grades intended to demonstrate the invention

| Example | Name | C ppm | Mn % | P % | S ppm | Si % | Ni % | Cr % | Cu % | Mo % | W % | N ppm |
|---|---|---|---|---|---|---|---|---|---|---|---|---|
| 1 | Base 304 | 573 | 0.99 | 0.003 | 9 | 0.27 | 9:48 | 17.81 | 0.30 | 0.15 | traces | 389 |
| 2 | 304Mo | 560 | 0.98 | 0.003 | 8 | 0.28 | 9:48 | 17.84 | 0.29 | 0.48 | traces | 412 |
| 3 | 304MoSi | 566 | 0.97 | 0.003 | 7 | 1:34 | 9:49 | 17.80 | 0.30 | 0.50 | traces | 488 |
| 4 | 304MoSiCu | 573 | 0.97 | 0.003 | 7 | 1:34 | 9:47 | 17.80 | 1.99 | 0.50 | traces | 621 |
| 5 | Base 304 | 551 | 0.98 | 0.003 | 6 | 0.30 | 9:47 | 17.84 | 0.30 | 0.15 | 0.008 | 428 |
| 6 | 304W | 539 | 0.97 | 0.003 | 6 | 0.29 | 9:48 | 17:57 | 0.30 | 0.15 | 0.35 | 421 |
| 7 | 304WSi | 532 | 0.96 | 0.003 | 6 | 1:42 | 9:52 | 17:49 | 0.30 | 0.15 | 0.46 | 422 |
| 8 | 304WSiCu | 508 | 0.96 | 0.003 | 5 | 1:42 | 9:51 | 17:53 | 2:00 | 0.15 | 0.45 | 428 |
| 9 | Base 316L | 211 | 1:27 | 0.003 | 9 | 0.37 | 10.79 | 16:42 | 0.29 | 1.98 | traces | 477 |
| 10 | 316LSi | 229 | 1:26 | 0.003 | 7 | 1:35 | 10.82 | 16:39 | 0.29 | 1.98 | traces | 611 |

Steel castings having the compositions listed in table 1 were carried out. Small ingots were obtained and samples 40 mm thick were extracted therefrom which were then hot rolled at 1150° C. to a thickness of 4 mm, then annealed at 1140-1120° C. and pickled. The ingots were then cold rolled to a thickness of 1.5 mm, annealed at 1140-1120° C., then cooled with forced air and pickled.

Such preparation method is entirely conventional for austenitic stainless-steels of the types the invention aims to replace, especially for the preferred contemplated applications which have been mentioned.

The following conclusions emerged therefrom:

The average grain sizes of the grades of 304 and the derivatives thereof range from 9.3 to 11.2 ASTM, as shown in Table 2, the ordinary 304 having the lowest average grain sizes (remember that a small grain size corresponds to a high ASTM value). Additions of Si, and especially Mo or W, contribute to increasing the average grain size. Grade 316L has an average grain size of 9 ASTM; the presence of 1.35% Si instead of 0.37%, all other things being otherwise substantially equal, slightly increases the average grain size (8.7 ASTM).

TABLE 2

Grain sizes obtained after cold rolling and annealing for the same thickness of 1.5 mm.

| Example | Name | Grain size ASTM |
|---|---|---|
| 1 | Base 304 | 11.2 |
| 2 | 304Mo | 9.5 |
| 3 | 304MoSi | 9.9 |
| 4 | 304MoSiCu | 9.3 |
| 5 | Base 304 | 10.8 |
| 6 | 304W | 9.4 |
| 7 | 304WSi | 10.2 |
| 8 | 304WSiCu | 9.2 |
| 9 | Base 316L | 9.0 |
| 10 | 316LSi | 8.7 |

Concerning the mechanical properties representative of the ability of the steel to be shaped, namely the conventional yield strength $Rp_{0.2}$. the tensile strength Rm and the elongation at break A, the following observations were made, as can be seen in FIGS. 1 to 3.

The addition of Mo alone to 304 in the proportions tested has no significant influence. The yield strength and the tensile strength remain higher than same of 316L. The latter exhibits an elongation at break slightly greater than the elongation at break of the 304 and derivatives thereof enriched in Mo and Si which were studied.

W added alone tends to rather reduce such properties.

It is especially the addition of Si, combined with the addition of Mo in the proportions examined, which has the most significant influence, more particularly on the elongation at break.

With regard to the resistance to pitting corrosion expressed in FIG. 4 by the pitting potential $Vpit_{0.1}$ in an environment with 0.02M NaCl at 23° C., the conventional 316L steels still have a better resistance than the 304 steels. However, we note that for both 304 and 316L, the addition of about 1.3% to 1.4% of Si in the 304 significantly increases the pitting potential. The best results of the tests are the results of the 304 steels to which 0.5% Mo and 1.3% Si have been added and which contain 17.4 to 17.8% Cr. The results are even better than the results obtained on a 316L with 1.98% Mo and 16.4% Cr, to which 1.35% Si would have been added.

W has no substantial effect on the pitting potential. According to the tests, the effect thereof is thus fully distinct from the effect of Mo.

The addition of Cu is detrimental since same decreases the pitting potential, all other things being otherwise equal.

It then appears that the higher concentration of Cr of the grades 304 and the association thereof with a moderate Mo content and an Si content greater than 1%, significantly increase the resistance to pitting corrosion of austenitic stainless-steels.

With regard to crevice corrosion, uniform corrosion and stress corrosion, again the addition of 0.5% Mo, either with or without additional Si, proves beneficial and leads to obtaining a performance comparable to the performance of the 316L.

The tests prior to the tests which led to the present invention have thus suggested that the solution consisting in adding a little Mo or a little Mo and Si to a conventional 304 steel could be, in terms of resistance to different types of corrosion, mechanical properties and cost, a good alternative to the use of 316 or 316L steels, richer in Ni and Mo than [the steels of] the present invention and, thus, substantially more expensive, with a more marked ecological footprint and the ability to be shaped which is not always optimal for the intended applications.

However, too strong an addition of Si in such a conventional 304 steel tended to increase the mechanical properties, including the hardness when hot, in a direction unfavorable to the formability of the material. It was found that for a concentration of Si of 1.35% associated with 0.5% Mo, the temperature A4 which marks the delta ferrite to austenite phase transformation, was too low and led, during hot rolling, to the formation of cracks on the edges of the product. Hence, an optimized solution still was to be found.

A balancing of the composition for obtaining a suitable A4 temperature, i.e. above the reheating temperature before hot rolling, is then necessary in order to ensure the integrity of the steel during hot rolling, and of the mechanical properties and of resistance to corrosion on finished product, compatible with the applications mainly contemplated for such steel: heat exchangers and chimney ducts.

In the light of previous tests, it was concluded that, to this end, it was desirable, a priori, to make the following adjustments in relation to the first attempts:

- keeping to significantly low concentrations of C, so as to limit the risk of intergranular corrosion;
- not adding Nb, at least not significantly, since Nb is an expensive element the advantages of which on the resistance to intergranular corrosion can also be obtained by lowering the concentration of C;
- maintaining sufficient Cr and Mo levels for providing the desired resistance to corrosion;
- minimizing the addition of Ni so as to limit the costs of materials;
- adjusting the concentration of N so as to achieve good hot ductility, requiring a suitable temperature A4; adjusting the concentration of Si so as to increase the temperature A4 and decrease the hardness, while maintaining the synergy between Mo and Si with regard to the resistance to corrosion, which was observed during the preliminary tests described.

For this purpose, ingots of 50 kg were cast, the compositions of which are given in Table 3. The elements not listed in the table are impurities. Examples 11 to 14 are according to the invention, example 15 is the reference 316L. In Examples 11 to 14, the concentration of Al is thus at most 0.06%, the concentration of Sn at most 0.05%, the concentration of Nb at most 0.08% (even less than 0.03%), the concentration of Ti at most 0.08%, the concentration of Zr at most 0.08%, the concentration of B at most 0.01%, the sum of the concentrations of W and Mo being at most 0.8%, and the concentration of Pb being at most 0.03%. The examples according to the invention differ from one another, in essence, on the content of Si thereof, which ranges, approximately, from 1.3% to 1.0%. It should be noted that Mo is uniformly set at 0.5% and that N allowed the gradual increase in Si to be compensated for.

TABLE 3

Compositions of examples of steels which have been cast

| Example | C % | Mn % | Si % | Ni % | Cr % | Cu % | Mo % | V % | Co % | N ppm | P % | S ppm | O ppm |
|---|---|---|---|---|---|---|---|---|---|---|---|---|---|
| 11 | 0.022 | 0.97 | 1.32 | 9.57 | 17.93 | 0.30 | 0.50 | 0.084 | 0.2 | 991 | 0.027 | 8 | 63 |
| 12 | 0.022 | 0.97 | 1.22 | 9.58 | 17.98 | 0.31 | 0.50 | 0.085 | 0.2 | 815 | 0.027 | 8 | 47 |
| 13 | 0.024 | 0.96 | 1.12 | 9.53 | 17.99 | 0.30 | 0.50 | 0.085 | 0.2 | 692 | 0.027 | 8 | 51 |
| 14 | 0.023 | 0.96 | 1.02 | 9.59 | 17.95 | 0.30 | 0.50 | 0.085 | 0.2 | 662 | 0.027 | 7 | 62 |
| 15 | 0.020 | 1.24 | 0.39 | 10.06 | 16.56 | 0.31 | 2.04 | 0.085 | 0.2 | 558 | 0.025 | 8 | 69 |

Samples of 150×100×25 mm were then cut out. The samples were hot rolled to reduce the thickness thereof from 25 to 2.8 mm.

A first annealing at 1100° C. was then carried out without holding, followed by etching, which resulted in total recrystallization of the samples and an oxide-free surface.

Cold rolling was carried then out to a final thickness of 1 mm for the samples, which is an ideal thickness for ensuring that the deep-drawing properties required for the applications are indeed obtained.

Final annealing operations were carried out at temperatures of 1075° C. and 1100° C., so as to achieve various average grain sizes.

As can be seen in FIG. 5, the results obtained in terms of grain size are very little different from one sample to another, for a given annealing temperature. The steels according to the invention and the 316L steel behave in a similar way. Annealing at 1075° C. results in all cases, in an average grain size on the order of 7.5 to 8 ASTM, and annealing at 1100° C. results in all cases, in an average grain size on the order of 8.5 to 9 ASTM, without clearly observing, in the case of the invention, any influence of the concentration of Si.

The average grain size of steel has considerable influence on the mechanical behavior thereof and in particular on the ability to be deep-drawn. The smaller the ASTM grain size, the more deformable the material. Thereby, for the targeted applications, and in particular for heat exchanger plates where the geometries are complex, the flexibility to adjust the grain size between 6 and 11 ASTM is a major asset for finding a good compromise between the ability to deform needed for deep-drawing the part and the mechanical strength needed for the resistance in service thereof.

Tensile tests were also carried out along the direction perpendicular to the rolling direction DL (in other words, along the transverse direction DT) on the samples annealed at the two aforementioned temperatures. The results of the tests are shown in FIG. 6 for the conventional yield strength $Rp_{0.2}$, in FIG. 7 for the tensile strength Rm, and in FIG. 8 for the elongation at break A %.

The following is clear therefrom:

- With regard to the conventional yield strength $Rp_{0.2}$ and the tensile strength Rm, the steels according to the invention have higher values, at equal average grain size, than the 316L; the values tend to decrease with the concentrations of Si and N; the steels according to the invention are harder than the 316L, even if the difference is reduced for a concentration of Si of about 1%;
- The elongation at break is fairly comparable for all the steels according to the invention and for 316L, with identical average grain size, and same varies relatively little when going from 8 ASTM to 9 ASTM.

Tensile tests were also carried out along three directions on the same two examples 14 and 15: the rolling direction DL, the transverse direction DT perpendicular to DL and the 45° direction, i.e. the bisector of the other two directions. The tests of FIGS. 6 to 8 were related only to the direction DT.

For all the tests, the samples 12.5 mm long, 50 mm wide and 1 mm thick tested were imparted, by means of a final annealing at 1080° C. without holding, with an average grain size of 8.6 ASTM for the example 14 according to the invention and 8.7 ASTM for the 316L reference example 15. The results of the tests, for $Rp_{0.2}$. Rm and A % are correspondingly visible in FIGS. 9, 10 and 11.

For $Rp_{0.2}$ and Rm, the two examples behave in substantially the same way, with deviations not exceeding 10 MPa for each measurement direction. The elongation at break A % is slightly higher for the example 14 according to the invention.

If the planar isotropy coefficient Δr of the two examples is calculated from the stress-strain curves along the three directions, it is found that Δr is equal to −0.286 for the example 15 for 316L and to −0.229 for the example 14 according to the invention. The good mechanical properties of the steel according to the invention, in that same have high mechanical strengths associated with large deformation at break and high isotropy, thus make a good substitute of said steel for the applications of 316L for which such properties are important, as is the resistance to various types of corrosion.

The formability of a grade can usefully be characterized by the yield strength, but additional tests have to be carried out in order to have a more precise idea, in particular if deep-drawing is intended. For this purpose, the examples 14 and 15 were subject to an Erichsen test and to a deep-drawing test.

The Erichsen test is aimed at obtaining the Erichsen index IE which corresponds to the depth of the deep-drawing before the occurrence of a crack, according to an equibiaxial stress.

A punch with a constant diameter of 20 mm, a constant blank holding pressure of 1000 daN, Molykote® lubricant spread with a brush, and a constant deep-drawing speed of 5 mm/minute, were used. The thickness of the tested sheet metal was 1 mm.

Example 14 according to the invention behaves slightly better than the reference example 15: The IE of the example 14 is 12 mm, the IE of the example 15 is 11.5 mm.

The Limiting Drawing Ratio (LDR) and the sensitivity to delayed breakage of examples 14 and 15, were also examined.

The LDR corresponds theoretically to the ratio β between the maximum diameter of the blank before cracking and the initial diameter of the punch The results are shown in FIGS. 12 and 13. The LDRs are very closer for both examples: 2.22 for the example 14 according to the invention (FIG. 13) and 2.17 for the reference example 15 (FIG. 12). The LDR of the example of according to the invention is even slightly better than the LDR of the reference steel 316L.

With regard to the sensitivity to delayed breakage, for a β ratio of 2.12, no delayed breakage was observed, in the two examples 14 and 15, in the case of a 2B finish (cold rolled product, non-bright annealing, pickled and subject to temper pass).

The deformation due to the elastic return after deep-drawing was also evaluated for the two examples 14 and 15. There is no noticeable difference in the respective behaviors thereof, which is consistent with the similarity of the yield strengths thereof.

Testing of the resistance to corrosion was also carried out, on the examples 11 and 14 according to the invention (containing 1.3% and 1.0% Si, respectively) and on the reference example 15 on 316L steel.

Electrochemical testing was performed on deep-drawn disks with diameters of 15 mm, polished under water with a SiC paper with grain size 1200. The disks were then degreased in an ultrasonic bath of acetone/ethanol, rinsed with distilled water, and left to age for 24 h in ambient air.

Electrochemical corrosion testing was performed in a solution of analytical grade distilled water and NaCl, de-aerated with nitrogen and hydrogen. A saturated calomel electrode (SCE) was used as the reference electrode and a platinum electrode as the counter electrode.

The resistance to pitting corrosion is expressed by the pitting corrosion potential $E_{pit}$, measured in mV/SCE on samples 11, 14 and 15 of Table 3 in a de-aerated NaCl solution at pH 6.6 leaving the sample at a free potential for 15 minutes and then performing a potentiodynamic scan at a constant scan rate (100 mV/minute) until reaching an intensity of 50 μA at which the potential $E_{pit}$ was measured. The experiments were conducted in 0.02M and 0.5M NaCl solutions at 23° C. and 50° C. The elementary pitting probability Pi in $cm^2$ was measured as a function of the corrosion potential $E_{pit}$. The results are shown in FIG. 14.

It turns out that the three samples have results very close to each other, under identical experimental conditions. In particular, the changes from a 0.02M NaCl solution to a 0.5 M NaCl solution and from a temperature of 23° C. to a temperature of 50° C. have the same influences regardless of the composition of the sample under consideration. FIG. 14 reflects the above finding, by showing the mean pitting corrosion potentials $E_{pit}$ and the standard deviations a thereof for each sample, as a function of the NaCl concentration of the solution and of the temperature thereof.

The positive effect of an addition of Si on pitting corrosion resistance in a type 304 stainless-steel is thus confirmed. With the presence of only 1.0% Si, the results obtained remain very comparable to the results for the 316L. With 1.3% Si in conjunction with 0.5% Mo, the resistance to pitting corrosion is even slightly improved for tests at 23° C., while remaining equivalent at 50° C.

As a comparison, identical tests were performed on a conventional 304 stainless-steel produced by industrial production and having a composition of 18.1% Cr, 0.29% Cu, 1.12% Mn, 0.29% Mo, 8% Ni, 0.42% Si, 0.049% C, 0.052% N and the rest of the elements being in trace amounts, and on a 316L steel having a composition of 17% Cr, 0.27% Cu, 1.44% Mn, 2.02% Mo, 10% Ni, 0.33% Si, 0.022% C, 0.035% N and the rest of the elements being in trace amounts. It was found (FIG. 15) that for the industrial 304 and a 0.02M NaCl solution, $E_{pit}$ can go down to 490 mV at 23° C. and 390 mV at 50° C. For a 0.5M NaCl solution, the same values are 300 mV and 180 mV, respectively. There is thus a very significant improvement in the resistance to pitting corrosion in the case of an addition of Mo and Si according to the invention, compared to a usual 304 steel, and the results obtained are competitive with the results obtained on the 316L, even at 50° C., with, however, a lower cost for materials.

We also took into account the PREN (Pitting Resistance Equivalent Number), which is a classic notion intended to predict the sensitivity of a stainless-steel to pitting corrosion. The PREN can be taken equal to % Cr+3.3x % Mo+16x % N. It can be seen in FIG. 15 that, at equal PREN, the gain on $E_{pit0.1}$ obtained by the addition of Mo and Si according to the invention to a conventional 304 steel, is estimated to be about 100 to 150 mV, in the case of an exposure to a 0.02M or 0.5M NaCl environment at 23° C. The gain is more moderate for the tests at 50° C. (not very significant at 23° C., 50 to 100 mV for 0.5M NaCl) but nevertheless remains interesting for the most difficult conditions encountered during testing. The above shows incidentally, that taken alone, PREN is not a sufficiently differentiating criterion for very finely predicting the sensitivity of a stainless-steel to corrosion resistance.

For the study of uniform corrosion, the passive layer was first removed from the three samples 11, 14, 15 and from the 304 sample coming from industrial production, the composition of which was given earlier, by immersion in a de-aerated solution of 2M sulfuric acid at a pH lower than the de-passivation pH (Phd), for 15 minutes at the rest potential $V_{corr}$. Potentiodynamic polarization tests were performed at a scan rate of 10 mV/minute, from −750 mV/SCE to 1800 mV/SCE. The current/voltage curves were determined. The curves are shown in FIG. 16.

The curves are very similar for the three samples. In particular, it emerges therefrom that the peak current $I_{crit}$, which is all the higher as the uniform corrosion of the metal is rapid, is substantially identical for the three samples tested: 0.25 mA/cm$^2$ for the 1.3% Si sample, 0.26 mA/cm$^2$ for the 1.0% Si sample and 0.20 mA/cm$^2$ for the 316 sample and 0.23 mA/cm$^2$ for the 304 sample coming from industrial production.

The conclusion therefrom is that the addition of 1.3% or 1.0% Si to an AISI 304 stainless-steel also containing 0.5% Mo provides identical results in terms of resistance to uniform corrosion, and that same is not significantly deteriorated compared to the resistance to uniform corrosion of an AISI 316L.

With regard to the resistance to stress corrosion, same was evaluated by a drop evaporation test according to ISO 15324, namely:

- Using a 0.1M aqueous NaCl solution at 23° C.;
- Spraying 10 drops/minute onto the part with a fall height of 1 cm;
- Heating the metal sample to 120° C. during the drop-by-drop test;
- U-bending the sample as per the standard ASTM G30;
- Imposing a mirror finish on the part.

The test measures the time at the end of which, cracking of the sample is observed. Three tests are performed for each example of grade. The results are shown in FIG. 17.

The samples 11 of 304 with an addition of 0.5% Mo and 1.3% Si have a rather large dispersion of the test results thereof: between 46 and 172 h before cracking. Samples 15 of 304 with an addition of 0.5% Mo and 1.0% Si have a smaller dispersion between 46 and 72 h. Samples 16 of 316L show cracking after 48 to 90 h.

The conclusion therefrom is that, apart from the usual experimental uncertainties, no obvious difference is found between the steels according to the invention and 316L, from the point of view of resistance to stress corrosion.

As a comparison, testing was performed on industrial samples of industrial AISI 304L steel (different from the conventional 304 by a lower maximum concentration of C, hence a priori by a better resistance to corrosion due to the lower risk of formation of Cr carbides) and from the industrial 316L. The results thereof are also shown in FIG. 17. The industrial 304L has a relatively modest resistance to stress corrosion, with a time before cracking of 22 to 26 h. The industrial 316L has a time before cracking of 42 to 48 h, hence comparable to what is observed on the best laboratory samples of the same grade and the 304 steels enriched in Mo and Si according to the invention. A more regular inclusionary cleanliness of industrial samples compared to laboratory samples can explain the lower dispersion of measurement results for same.

The resistance to crevice corrosion of the two examples 14 and 15 was also evaluated. The simulation of an environment conducive to crevice corrosion (low pH and high chloride ion concentration) was performed by means of a 2M NaCl solution at a pH of less than 3, adjusted by the addition of hydrochloric acid, maintained at 23° C. The aim was, for each sample, to determine the pH for destroying the passivation layer thereof.

For this purpose, the samples were first subject, for 2 minutes, to a cathodic polarization at −750 mV/SCE, then left at the rest potential thereof. Then potentiodynamic measurements were started at a scan rate of 10 mV/minute in the anodic direction, from −750 mV/SCE. The measurements were carried out at different pH values in order to determine the maximum intensity in the active range of the polarization curves. The results thereof are shown in FIG. 18.

It is clear therefrom that the two samples again have very similar behaviors. The de-passivation pH is, in both cases, between 1 and 1.2 which is a range of values which compares favorably with the range of the ordinary industrial AISI 304 (1.7-2.3), and also to the range of the ordinary industrial 316 (1.5-1.65).

Good resistance to crevice corrosion is particularly sought after e.g. for chimney ducts which are in contact with flue gas condensates and under assembly conditions conducive for the occurrence of such corrosion. At the end of all the results, the resistance to different types of corrosion of the two grades according to the invention at 0.5% Mo and 1.3% or 1.0% Si which have been thoroughly tested, is thus not significantly lower than the resistance to corrosion of the conventional 316L.

In conclusion, it is thus confirmed that the joint presence of Si and Mo, in the precise proportions according to the invention, in a stainless-steel, the composition of which, with regard to the other points, is close to the composition of X2CrNi189 (1.4307), comparable to AISI 304L, has beneficial effects on the properties of resistance to various types of corrosion and on the ability of the steel to be shaped. The properties sought herein are very similar to, or even superior to, the properties of 316L, which allows the steel according to the invention to economically replace, without metallurgical disadvantages, an X2CrNiMo17-12-2. comparable to AISI 316L, for uses which require such qualities, such as the manufacture of heat exchanger plates and chimney ducts.

The invention claimed is:

1. Austenitic stainless-steel, made of a steel having a composition consisting of, in weight percentages:

traces≤C≤0.03%;
1.0%≤Mn≤2.0%;
0.8%≤Si≤2.0%;
traces≤Al≤0.06%;
traces≤P≤0.045%;
traces≤S≤0.015%;
8.0%≤Ni≤12.0%;
17.5%≤Cr<20.0%;
0.4%≤Mo≤0.8%;
traces≤Sn≤0.05%;
traces≤Nb≤0.08%;
traces≤V≤0.15%;
traces≤Ti≤0.08%;
traces≤Zr≤0.08%;
traces≤Co≤1.0%;
0.02%≤Cu≤0.6%;
traces≤B≤0.01%;
traces≤W+Mo≤0.8%;

traces≤Pb≤0.03%;

traces≤N<1000 ppm;

traces≤O≤0.01%;

and a remainder, the remainder being iron and impurities resulting from production.

2. The austenitic stainless-steel according to claim 1, wherein the austenitic stainless-steel has an average grain size thereof between 11 ASTM and 6 ASTM.

3. The austenitic stainless-steel according to claim 1, wherein traces≤Nb≤0.03%.

4. The austenitic stainless-steel according to claim 3, wherein traces≤Nb≤0.02%.

5. The austenitic stainless-steel according to claim 1, wherein 0.03%≤V≤0.15%.

6. The austenitic stainless-steel according to claim 5, wherein 0.04%≤V≤0.15%.

7. The austenitic stainless-steel according to claim 1, wherein 300 ppm≤N<1000 ppm.

8. The austenitic stainless-steel according to claim 7, wherein 300 ppm≤N<800 ppm.

9. A heat exchanger plate made of the austenitic stainless-steel according to claim 1.

10. An element of a chimney duct, made of the austenitic stainless-steel according to claim 1.

11. The austenitic stainless-steel according to claim 1, wherein 1.0%≤Si≤1.5%.

12. The austenitic stainless-steel according to claim 1, wherein traces≤Al≤0.01%.

13. The austenitic stainless-steel according to claim 1, wherein 9.45%≤Ni≤10.0%.

14. The austenitic stainless-steel according to claim 1, wherein 0.5%≤Mo≤0.6%.

15. The austenitic stainless-steel according to claim 1, wherein traces≤O≤0.005%.

16. The austenitic stainless-steel according to claim 1, wherein the austenitic stainless-steel has an average grain size between 10 ASTM and 7 ASTM.

* * * * *